US011353803B2

(12) United States Patent
Sugawara et al.

(10) Patent No.: US 11,353,803 B2
(45) Date of Patent: Jun. 7, 2022

(54) TONER FOR ELECTROSTATIC IMAGE DEVELOPMENT, ELECTROSTATIC IMAGE DEVELOPER, AND TONER CARTRIDGE

(71) Applicant: FUJIFILM Business Innovation Corp., Tokyo (JP)

(72) Inventors: Atsushi Sugawara, Kanagawa (JP); Shintaro Anno, Kanagawa (JP); Yoshimasa Fujihara, Kanagawa (JP); Daisuke Noguchi, Kanagawa (JP); Satoshi Miura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/152,016

(22) Filed: Jan. 19, 2021

(65) Prior Publication Data

US 2022/0091521 A1 Mar. 24, 2022

(30) Foreign Application Priority Data

Sep. 23, 2020 (JP) ..... JP2020-159121

(51) Int. Cl.
*G03G 9/087* (2006.01)
*G03G 9/08* (2006.01)

(52) U.S. Cl.
CPC ..... *G03G 9/0821* (2013.01); *G03G 9/0819* (2013.01); *G03G 9/0825* (2013.01); *G03G 9/08755* (2013.01); *G03G 9/08782* (2013.01)

(58) Field of Classification Search
CPC ..... G03G 9/0825; G03G 9/08755
See application file for complete search history.

(56) References Cited

U.S. PATENT DOCUMENTS

2016/0363877 A1* 12/2016 Hama ..... G03G 9/0825
2020/0183295 A1* 6/2020 Kanno ..... G03G 9/0825

FOREIGN PATENT DOCUMENTS

JP 2017-003990 A 1/2017
JP 2019-040024 A 3/2019

* cited by examiner

*Primary Examiner* — Peter L Vajda
(74) *Attorney, Agent, or Firm* — Sughrue Mion, PLLC

(57) ABSTRACT

A toner for electrostatic image development includes toner particles containing an amorphous resin and a crystalline resin. The toner particles include first toner particles. When a cross section of each of the first toner particles is observed, at least two domains of the crystalline resin satisfy conditions (A), (B1), (C), and (D) below:

condition (A): an aspect ratio of each of the at least two domains of the crystalline resin is from 5 to 40 inclusive;

condition (B1): a length of a major axis of each of the at least two domains of the crystalline resin is from 0.5 μm to 1.5 μm inclusive;

condition (C): an angle between an extension of the major axis of each of the at least two domains of the crystalline resin and a tangent at the point of contact of the extension with a surface of the each of the first toner particles is from 60 degrees to 90 degrees inclusive; and condition (D): a crossing angle between extensions of major axes of any two of the at least two domains of the crystalline resin is from 45 degrees to 90 degrees inclusive.

8 Claims, 3 Drawing Sheets

TONER FOR ELECTROSTATIC IMAGE DEVELOPMENT, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2020-159121 filed Sep. 23, 2020.

BACKGROUND

(i) Technical Field

The present disclosure relates to a toner for electrostatic image development, to an electrostatic image developer, and to a toner cartridge.

(ii) Related Art

Image information visualization methods such as an electrophotographic method are currently used in various fields. In the electrophotographic methods, electrification and electrostatic image formation are performed to form an electrostatic image as image information on a surface of an image-holding member. Then a developer containing a toner is used to form a toner image on the surface of the image-holding member. The toner image is transferred to a recording medium and then fixed to the recording medium. The image information is visualized as an image through the above steps.

For example, Japanese Unexamined Patent Application Publication No. 2019-40024 discloses "a toner including a plurality of toner particles each including a toner core and a shell layer covering the surface of the toner core, wherein the toner core contains a melt-kneaded product containing an amorphous resin and a crystalline resin, wherein the shell layer contains a thermosetting resin, wherein the melt-kneaded product includes a plurality of crystalline resin domains, and wherein, among the plurality of crystalline resin domains included in each toner particle, the ratio of the number of domains satisfying the condition that their minor axis diameter is from 50 nm and 200 nm inclusive and the condition that their aspect ratio is from 4.0 to 20 inclusive is 80% by number or more."

Japanese Unexamined Patent Application Publication No. 2017-003990 discloses "a toner including toner particles each containing an amorphous polyester resin, a crystalline polyester resin, and a wax, wherein, in a cross-section of the toner observed under a transmission electron microscope (TEM), domains of the wax and crystals of the crystalline polyester resin are present, wherein the ratio of the area occupied by the domains of the wax to the cross sectional area of the toner is from 0.5% to 8.0% inclusive, wherein the ratio of the area occupied by the crystals of the crystalline polyester resin to the cross sectional area of the toner is from 0.5% to 8.0% inclusive, wherein the number average diameter (Dw) of the domains of the wax is from 60 nm to 240 nm inclusive, wherein the aspect ratio of each of the crystals of the crystalline polyester resin is from 5.0 to 25.0 inclusive, and wherein the number average diameter (Dc) of the major axis lengths of the crystals of the crystalline polyester resin is from 0.8 to 2.0 times the number average diameter (Dw) of the domains of the wax."

SUMMARY

Aspects of non-limiting embodiments of the present disclosure relate to a toner for electrostatic image development including toner particles containing an amorphous resin and a crystalline resin. With this toner for electrostatic image development, the degree of unevenness in image gloss that occurs when an image with a large toner mass per unit area is formed is smaller than that in an image formed using a toner containing only toner particles in which, when a cross section of each toner particle is observed, all crystalline resin domains do not satisfy any of conditions (A), (B1), (C), and (D) described later or do not satisfy any of conditions (A), (B2), (C), and (D) described later.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a toner for electrostatic image development including toner particles containing an amorphous resin and a crystalline resin, wherein the toner particles include first toner particles, and wherein, when a cross section of each of the first toner particles is observed, at least two domains of the crystalline resin satisfy conditions (A), (B1), (C), and (D) below:

condition (A): an aspect ratio of each of the at least two domains of the crystalline resin is from 5 to 40 inclusive;

condition (B1): a length of a major axis of each of the at least two domains of the crystalline resin is from 0.5 μm to 1.5 μm inclusive;

condition (C): an angle between an extension of the major axis of each of the at least two domains of the crystalline resin and a tangent at a point of contact of the extension with a surface of the each of the first toner particles is from 60 degrees to 90 degrees inclusive; and condition (D): a crossing angle between extensions of major axes of any two of the at least two domains of the crystalline resin is from 45 degrees to 90 degrees inclusive.

BRIEF DESCRIPTION OF THE DRAWINGS

Exemplary embodiments of the present disclosure will be described in detail based on the following figures, wherein.

DETAILED DESCRIPTION

Figure 1:
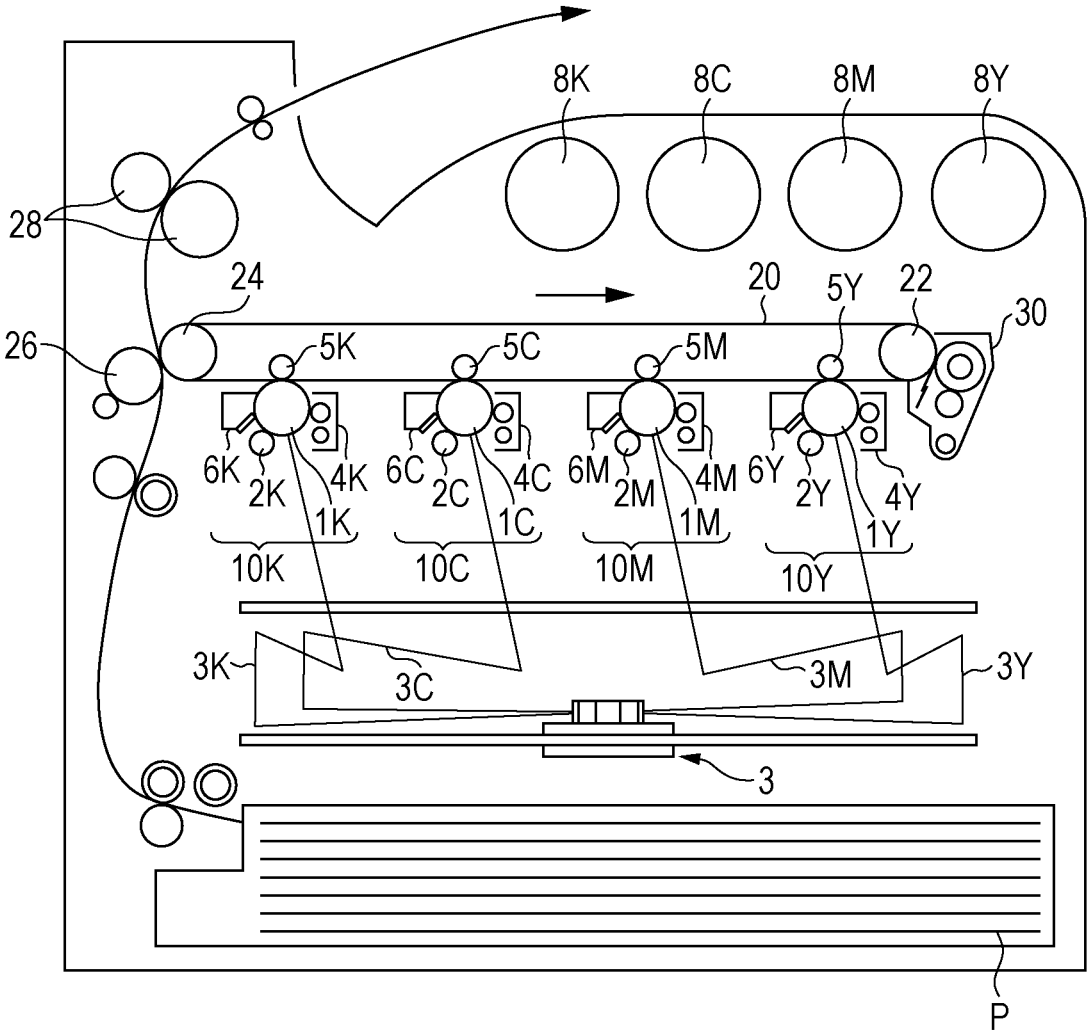
FIG. 1 is a schematic configuration diagram of an image forming apparatus according to an exemplary embodiment.

Exemplary embodiments of the present disclosure will be described below in detail.

In a set of numerical ranges expressed in a stepwise manner, the upper or lower limit in one numerical range may be replaced with the upper or lower limit in another numerical range in the set.

Moreover, the upper or lower limit in a numerical range may be replaced with a value indicated in an Example.

When a composition contains a plurality of materials corresponding to the same component, the amount of the component means the total amount of the plurality of materials present in the composition, unless otherwise specified.

The term "step" is meant to include not only an independent step but also a step that is not clearly distinguishable from other steps, so long as the prescribed purpose of the step can be achieved.

<Toner for Electrostatic Image Development>

First Exemplary Embodiment

A toner for electrostatic image development (hereinafter referred to as a "toner") according to a first exemplary embodiment includes first toner particles containing an amorphous resin and a crystalline resin. When a cross section of each of the first toner particles is observed, at least two domains of the crystalline resin satisfy the following conditions (A), (B1), (C), and (D):

condition (A): the aspect ratio of each of the at least two domains of the crystalline resin is from 5 to 40 inclusive;

condition (B1): the length of the major axis of each of the at least two domains of the crystalline resin is from 0.5 μm to 1.5 μm inclusive;

condition (C): the angle between an extension of the major axis of each of the at least two domains of the crystalline resin and a tangent at the point of contact of the extension with the surface of the each of the first toner particles is from 60 degrees to 90 degrees inclusive; and condition (D): the crossing angle between extensions of the major axes of any two of the at least two domains of the crystalline resin is from 45 degrees to 90 degrees inclusive.

With the toner according to the first exemplary embodiment having the above structure, the degree of unevenness in image gloss when an image with a large toner mass per unit area is formed is reduced. The reason for this may be as follows.

For the purpose of imparting a three-dimensional texture to an image, so called high-density printing is sometimes used to form a three-dimensional image. In the high-density printing, printing is generally repeated many times. The larger the number of repetitions of printing, the longer the time of printing, and the more likely misregistration is to occur. Therefore, there is a need for means for reducing the number of repetition of printing by increasing the toner mass per unit area. In one known technique, toner particles containing elliptical crystalline resin domains are used (for example, Japanese Unexamined Patent Application Publication No. 2019-40024). With this toner, when a toner image is fixed, the amorphous resin and the crystalline resin are mixed with each other, so that the toner particles can easily melt.

However, in the toner in this technique, all the crystalline resin domains in each toner particle are directed in the same direction. Therefore, the crystalline resin may be present nonuniformly on the toner particle surface. In this case, when the toner mass per unit area is increased (for example, the toner mass per unit area is increased to 10.0 g/m$^2$ or more), heat is unlikely to transfer uniformly over the entire toner particles, and this may cause uneven melting of the toner particles during fixation of a toner image. This may result in unevenness in gloss of the image.

However, with the first toner particles satisfying the conditions described above, heat can transfer substantially uniformly within the toner particles, so that uneven melting of the toner particles during fixation of a toner image is unlikely to occur.

Figure 3:
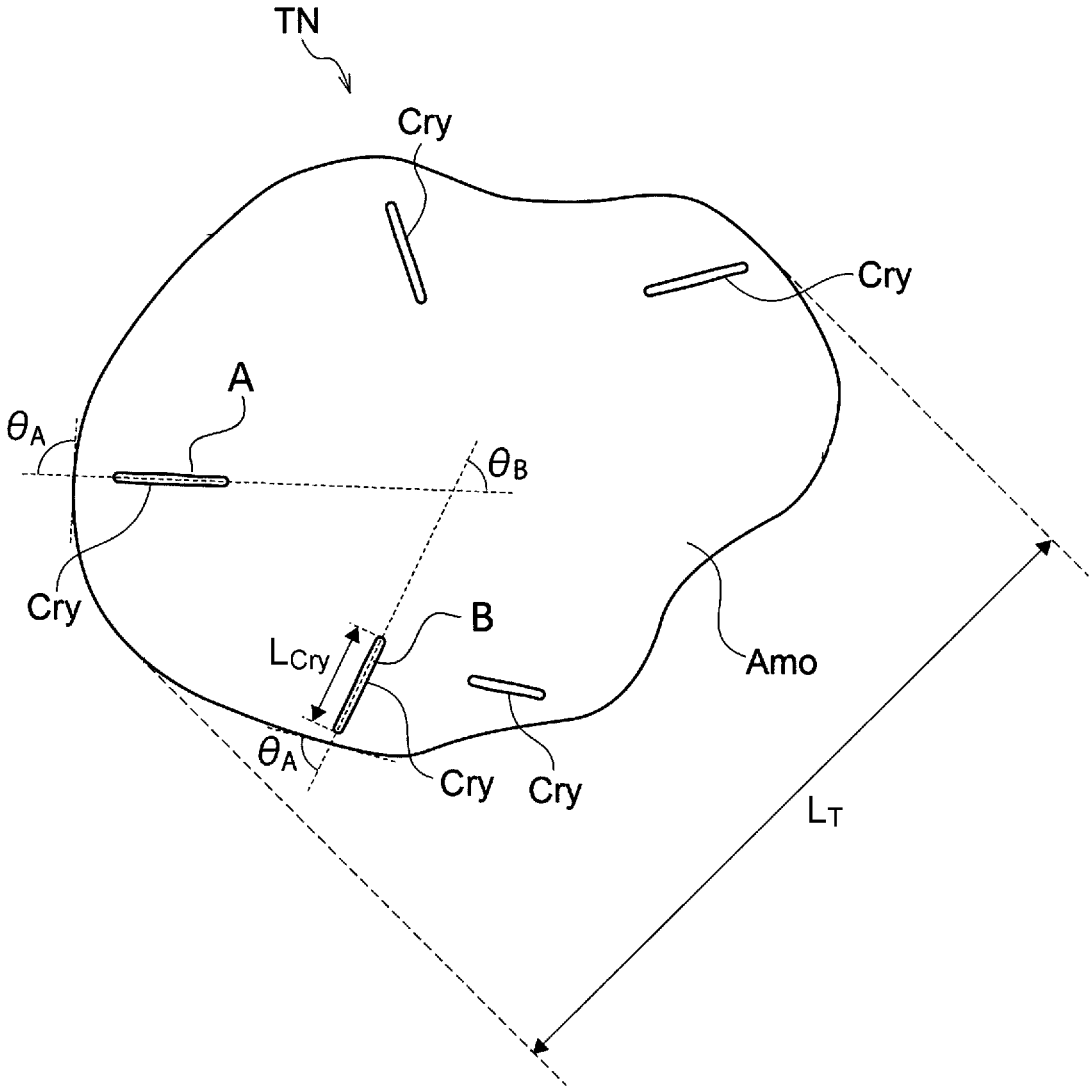
FIG. 3 is a schematic illustration showing a cross section of a toner particle in a toner for electrostatic image development according to an exemplary embodiment.

The first toner particles satisfying the above conditions mean that, in each toner particle, two crystalline resin domains each having an elliptical or needle shape with a large aspect ratio and each having a large major axis length extend from the surface side of the toner particle toward the inner side such that extensions of their major axes cross each other (see FIG. 3).

When, during the fixation of a toner image including the first toner particles satisfying the above conditions, heat is applied to the first toner particles, the elliptical or needle-shaped crystalline resin melts, so that the heat can easily transfer from the surface of the first toner particles to their inside. Therefore, the heat transfers substantially uniformly over the entire toner particles, and the entire toner particles can easily melt substantially uniformly.

Therefore, even when the toner mass per unit area is increased (for example, the toner mass per unit area is increased to 10.0 g/m$^2$ or more), uneven melting of the toner particles is unlikely to occur during the fixation of a toner image.

This may be the reason why the degree of unevenness in image gloss when an image with a large toner mass per unit area is formed using the toner according to the first exemplary embodiment is small.

Second Exemplary Embodiment

A toner for electrostatic image development (hereinafter referred to as a "toner") according to a second exemplary embodiment includes second toner particles containing an amorphous resin and a crystalline resin. When a cross section of each of the second toner particles is observed, at least two domains of the crystalline resin satisfy the following conditions (A), (B2), (C), and (D):

condition (A): the aspect ratio of each of the at least two domains of the crystalline resin is from 5 to 40 inclusive;

condition (B2): in at least one of the at least two domains of the crystalline resin, the ratio of the length of the major axis to the maximum diameter of the each of the second toner particles is from 10% to 30% inclusive;

condition (C): the angle between an extension of the major axis of each of the at least two domains of the crystalline resin and a tangent at the point of contact of the extension with the surface of the each of the second toner particles is from 60 degrees to 90 degrees inclusive; and condition (D): the crossing angle between extensions of the major axes of any two of the at least two domains of the crystalline resin is from 45 degrees to 90 degrees inclusive.

With the toner according to the second exemplary embodiment having the above structure, the degree of unevenness in image gloss when an image with a large toner mass per unit area is formed is reduced. The reason for this may be as follows.

With the second toner particles satisfying the conditions described above, heat can transfer substantially uniformly within the toner particles, so that uneven melting of the toner particles during fixation of a toner image is unlikely to occur.

Like the first toner particles in the first exemplary embodiment, the second toner particles satisfying the above conditions mean that, in each toner particle, two crystalline resin domains each having an elliptical or needle shape with a large aspect ratio and each having a large major axis length extend from the surface side of the toner particle toward the inner side such that extensions of their major axes cross each other (see FIG. 3).

Therefore, with the second toner particles, as with the first toner particles in the first exemplary embodiment, even when the toner mass per unit area is increased (for example, the toner mass per unit area is increased to 10.0 g/m$^2$ or more), uneven melting of the toner particles is unlikely to occur during the fixation of a toner image.

When, during the fixation of a toner image including the second toner particles satisfying the above conditions, heat is applied to the second toner particles, the elliptical or needle-shaped crystalline resin melts, so that the heat can easily transfer from the surface of the second toner particles to their inside. Therefore, the heat transfers substantially uniformly over the entire toner particles, and the entire toner particles can easily melt substantially uniformly.

This may be the reason why the degree of unevenness in image gloss when an image with a large toner mass per unit area is formed using the toner according to the second exemplary embodiment is small.

Letter symbols shown in FIG. 3 are as follows.

TN: toner particle

Amo: amorphous resin

Cry: crystalline resin $L_{Cry}$: The length of the major axis of the crystalline resin domain $L_T$: The maximum diameter of the toner particle $\theta_A$: The angle between an extension of the major axis of a crystalline resin domain and a tangent at the point of contact of the extension with the surface of the toner particle $\theta_B$: The crossing angle between extensions of the major axes of two crystalline resin domains A toner corresponding to both the toners according to the first and second exemplary embodiments (hereinafter referred to as "a toner according to the present exemplary embodiment") will be described in detail. For example, the toner according to the present exemplary embodiment of the disclosure may be a toner corresponding to one of the toners according to the first and second exemplary embodiments. In the following description, both the first toner particles and the second toner particles are referred to as toner particles.

The toner according to the present exemplary embodiment includes toner particles. The toner may contain an external additive.

(Toner Particles)

The toner particles contain an amorphous resin and a crystalline resin that serve as a binder resin. The toner particles may contain a coloring agent, a release agent, and additional additives.

—Form of Crystalline Resin Domains in Toner Particles—

When a cross section of a toner particle is observed, at least two crystalline resin domains (preferably at least three crystalline resin domains) satisfy condition (A), condition (B1), condition (B2), condition (C), and condition (D). However, it is only necessary that the at least two crystalline resin domains satisfy at least one of condition (B1) and condition (B2).

From the viewpoint of reducing unevenness in gloss of an image, the ratio of the number of toner particles satisfying these conditions to the total number of toner particles is preferably 40% by number or more, more preferably 70% by number or more, still more preferably 80% by number or more, and particularly preferably 90% by number or more. Ideally, the ratio of the number of toner particles satisfying the above conditions is 100% by number.

The larger the number of toner particles satisfying the above conditions, the easier the toner particles as a whole can melt substantially uniformly, and the easier the unevenness in gloss of an image can be reduced.

The ratio of the number of toner particles satisfying below-described preferred ranges in the conditions to the total number of toner particles is preferably 40% by number or more, more preferably 70% by number or more, still more preferably 80% by number or more, and particularly preferably 90% by number or more from the viewpoint of reducing unevenness in gloss of an image, as in the above case. Ideally, the ratio of the number of toner particles satisfying the preferred ranges in the conditions is 100% by number.

Each of the above conditions will next be described.

—Condition (A)

The aspect ratio of each crystalline resin domain is from 5 to 40 inclusive.

From the viewpoint of reducing unevenness in gloss of an image, the aspect ratio of the crystalline resin domain is preferably from 10 to 40 inclusive.

The aspect ratio of a crystalline resin domain means the ratio of the length of the major axis of the crystalline resin domain to the length of its minor axis (the length of the major axis/the length of the minor axis).

The length of the major axis of the crystalline resin domain means the maximum length of the crystalline resin domain.

The length of the minor axis of the crystalline resin domain means the maximum length of a line segment orthogonal to the extension of the major axis of the crystalline resin domain.

—Condition (B1)

The length of the major axis of each crystalline resin domain (see $L_{Cry}$ in FIG. 3) is from 0.5 μm to 1.5 μm inclusive.

From the viewpoint of reducing unevenness in gloss of an image, the length of the major axis of each crystalline resin domain is preferably from 0.8 μm to 1.5 μm inclusive.

—Condition (B2)

In at least one of the at least two crystalline resin domains, the ratio of the length of the major axis (see $L_{Cry}$ in FIG. 3) to the maximum diameter of the toner particle (see $L_T$ in FIG. 3) is from 10% to 30% inclusive.

From the viewpoint of reducing unevenness in gloss of an image, the ratio of the length of the major axis of the crystalline resin domain to the maximum diameter of the toner particle is preferably from 13% to 30% inclusive and more preferably from 17% to 30% inclusive.

The maximum diameter of the toner particle means the maximum length of a straight line connecting two arbitrary points on the outline of the toner particle (its major axis).

—Condition (C)

The angle (see $\theta_A$ in FIG. 3) between an extension of the major axis of each crystalline resin domain and a tangent at the point of contact of the extension with the surface of the toner particle (i.e., the outer edge of the toner particle) is from 60 degrees to 90 degrees inclusive.

From the viewpoint of reducing unevenness in gloss of an image, the angle between the extension of the major axis of the crystalline resin domain and the tangent at the point of contact of the extension with the surface of the toner particle is preferably from 75 degrees to 90 degrees inclusive.

—Condition (D)

The crossing angle (see $\theta_B$ in FIG. 3) between extensions of the major axes of any two of the at least two crystalline resin domains is from 45 degrees to 90 degrees inclusive.

From the viewpoint of reducing unevenness in gloss of an image, the crossing angle (see $\theta_B$ in FIG. 3) between the extensions of the major axes of any two of the at least two crystalline resin domains is preferably from 60 degrees to 90 degrees inclusive.

When three or more crystalline resin domains satisfying conditions (A), (B1), and (C) or satisfying conditions (A), (B2), and (C) are present in a toner particle, it is only necessary that any two of these crystalline resin domains satisfy condition (D).

—Method for Observing Cross Sections of Toner Particles

A method for observing cross sections of toner particles to determine whether or not the toner particles satisfy condition (A), condition (B1), condition (B2), condition (C), and condition (D) is as follows.

Toner particles (or toner particles with an external additive adhering thereto) are mixed with an epoxy resin to embed the toner particles in the epoxy resin, and then the epoxy resin is cured. The cured product obtained is cut using an ultramicrotome (Ultracut UCT manufactured by Leica) to produce a thin sample with a thickness of from 80 nm to 130 nm inclusive. Next, the obtained thin sample is stained with ruthenium tetroxide for 3 hours in a desiccator at 30° C. Then an STEM observation image (acceleration voltage: 30 kV, magnification: 20000×) of the stained thin sample is taken using an ultra-high-resolution field-emission scanning electron microscope (FE-SEM, S-4800 manufactured by Hitachi High-Technologies Corporation) in a transmission image mode.

In each toner particle, the crystalline polyester resin and the release agent are distinguished from each other based on their contrast and shape. In the SEM image, the crystalline resin, the amorphous resin, the release agent, etc. are stained with ruthenium. The binder resin other than the release agent has a larger number of double bond moieties and is stained with ruthenium tetroxide, so that release agent portions and the resin portions other than the release agent portions are distinguishable from each other.

Specifically, the release agent domains are stained with ruthenium most weakly, and the crystalline resin (e.g., the crystalline polyester resin) is stained moderately. The amorphous resin (e.g., the amorphous polyester resin) is stained most intensely. By adjusting contrast, the release agent is observed as white domains, and the amorphous resin is observed as black domains. Moreover, the crystalline resin is observed as light gray domains.

The regions of the crystalline resin stained with ruthenium are subjected to image analysis to determine whether or not the toner particles satisfy condition (A), condition (B1), condition (B2), condition (C), and condition (D).

When the ratio of the toner particles satisfying the above conditions is determined, 100 toner particles are observed, and the ratio of the toner particles satisfying the above conditions is computed.

Cross sections of toner particles with various sizes are contained in an SEM image. Cross sections of toner particles having a diameter of 85% or more of the volume average particle diameter of the toner particles are selected and used as the toner particles for observation. The diameter of a toner particle is the maximum length of a straight line connecting two arbitrary points on the outline of the toner particle (its major axis).

—Binder Resin—

The amorphous resin and the crystalline resin are used as the binder resin.

The mass ratio of the crystalline resin to the amorphous resin (the crystalline resin/the amorphous resin) is preferably from 3/97 to 50/50 inclusive and more preferably from 7/93 to 30/70 inclusive.

The amorphous resin exhibits only a stepwise endothermic change instead of a clear endothermic peak in thermal analysis measurement using differential scanning calorimetry (DSC), is a solid at room temperature, and is thermoplastic at temperature equal to or higher than its glass transition temperature.

The crystalline resin exhibits a clear endothermic peak instead of a stepwise endothermic change in the differential scanning calorimetry (DSC).

Specifically, the crystalline resin means that, for example, the half width of the endothermic peak measured at a heating rate of 10° C./minute is 10° C. or less, and the amorphous resin means a resin in which the half width exceeds 10° C. or a resin in which a clear endothermic peak is not observed.

The amorphous resin will be described.

Examples of the amorphous resin include well-known amorphous resins such as amorphous polyester resins, amorphous vinyl resins (such as styrene-acrylic resins), epoxy resins, polycarbonate resins, and polyurethane resins. Of these, amorphous polyester resins, amorphous vinyl resins (particularly styrene-acrylic resins), and amorphous polyester resins are preferred, and amorphous polyester resins are more preferred.

The amorphous resin may be a combination of an amorphous polyester resin and a styrene-acrylic resin.

The amorphous polyester resin is, for example, a polycondensation product of a polycarboxylic acid and a polyhydric alcohol. The amorphous polyester resin used may be a commercial product or a synthesized product.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl (having, for example, 1 to 5 carbon atoms) esters thereof. In particular, the polycarboxylic acid may be, for example, an aromatic dicarboxylic acid.

The polycarboxylic acid used may be a combination of a dicarboxylic acid and a tricarboxylic or higher polycarboxylic acid having a crosslinked or branched structure. Examples of the tricarboxylic or higher polycarboxylic acid include trimellitic acid, pyromellitic acid, anhydrides thereof, and lower alkyl (having, for example, 1 to 5 carbon atoms) esters thereof.

Any of these polycarboxylic acids may be used alone or in combination of two or more.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). In particular, the polyhydric alcohol is, for example, preferably an aromatic diol or an alicyclic diol and more preferably an aromatic diol.

The polyhydric alcohol used may be a combination of a diol and a trihydric or higher polyhydric alcohol having a crosslinked or branched structure. Examples of the trihydric or higher polyhydric alcohol include glycerin, trimethylolpropane, and pentaerythritol.

Any of these polyhydric alcohols may be used alone or in combination of two or more.

The amorphous polyester resin is obtained by a well-known production method. Specifically, the amorphous polyester resin is obtained, for example, by the following method. The reaction is performed at a polymerization temperature of from 180° C. to 230° C. inclusive, and the pressure inside the reaction system is reduced, if necessary, to remove water and alcohol generated during condensation.

When the raw material monomers are not dissolved or not compatible with each other at the reaction temperature, a high-boiling point solvent may be added as a solubilizer to dissolve the monomers. In this case, the polycondensation reaction is performed while the solubilizer is removed by evaporation. When a monomer with poor compatibility is present, the monomer with poor compatibility and an acid or an alcohol to be polycondensed with the monomer are condensed in advance, and then the resulting polycondensation product and the rest of the components are subjected to polycondensation.

Examples of the amorphous polyester resin other than the unmodified amorphous polyester resins described above include modified amorphous polyester resins. The modified amorphous polyester resin is an amorphous polyester resin including a bonding group other than the ester bonds or an amorphous polyester resin including a resin component that is different from the amorphous polyester resin component and is bonded through a covalent bond, an ionic bond, etc. Examples of the modified amorphous polyester resin include: an amorphous polyester resin in which a functional group such as an isocyanate group reactable with an acid group or a hydroxy group is introduced into an end of the resin; and a resin reacted with an active hydrogen compound to modify an end of the resin.

The styrene-acrylic resin is a copolymer obtained by copolymerization of at least a styrene-based monomer (a monomer having a styrene skeleton) and a (meth)acrylic-based monomer (a monomer having a (meth)acrylic group, preferably a monomer having a (meth)acryloxy group). Examples of the styrene-acrylic resin include a copolymer of a styrene-based monomer and a (meth)acrylate-based monomer.

The acrylic resin portions of the styrene-acrylic resin are partial structures obtained by polymerizing an acrylic-based monomer, a methacrylic-based monomer, or both of them. The term "(meth)acrylic" includes both "acrylic" and "methacrylic."

Specific examples of the styrene-based monomer include styrene, alkyl-substituted styrenes (such as α-methylstyrene, 2-methylstyrene, 3-methylstyrene, 4-methylstyrene, 2-ethylstyrene, 3-ethylstyrene, and 4-ethylstyrene), halogen-substituted styrenes (such as 2-chlorostyrene, 3-chlorostyrene, and 4-chlorostyrene), and vinylnaphthalene. Any of these styrene-based monomers may be used alone or in combination of two or more.

In particular, from the viewpoint of ease of reaction, ease of controlling the reaction, and availability, the styrene-based monomer is preferably styrene.

Specific examples of the (meth)acrylic-based monomer include (meth)acrylic acid and (meth)acrylates. Examples of the (meth)acrylates include alkyl (meth)acrylates (such as methyl (meth)acrylate, ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth) acrylate, n-lauryl (meth) acrylate, n-tetradecyl (meth) acrylate, n-hexadecyl (meth) acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth) acrylate, 2-ethylhexyl (meth) acrylate, cyclohexyl (meth)acrylate, and t-butylcyclohexyl (meth)acrylate), aryl (meth)acrylates (such as phenyl (meth)acrylate, biphenyl (meth) acrylate, diphenylethyl (meth) acrylate, t-butylphenyl (meth)acrylate, and terphenyl (meth)acrylate), dimethylaminoethyl (meth) acrylate, diethylaminoethyl (meth) acrylate, methoxyethyl (meth) acrylate, 2-hydroxyethyl (meth)acrylate, β-carboxyethyl (meth)acrylate, and (meth)acrylamide. Any of these (meth)acrylic-based monomers may be used alone or in combination of two or more.

Among these (meth)acrylic-based monomers, (meth) acrylates are preferable. From the viewpoint of fixability, (meth)acrylates having an alkyl group having 2 to 14 carbon atoms (preferably 2 to 10 carbon atoms and more preferably 3 to 8 carbon atoms) are preferable.

In particular, n-butyl (meth)acrylate is preferable, and n-butyl acrylate is particularly preferable.

No particular limitation is imposed on the copolymerization ratio of the styrene-based monomer to the (meth) acrylic-based monomer (mass ratio: styrene-based monomer/(meth)acrylic-based monomer), but the copolymerization ratio may be 85/15 to 70/30.

The styrene-acrylic resin may have a cross-linked structure. Examples of the styrene-acrylic resin having a cross-linked structure include a copolymer of at least a styrene-based monomer, a (meth)acrylic acid-based monomer, and a cross-linkable monomer.

Examples of the cross-linkable monomer include bifunctional and higher functional cross-linking agents.

Examples of the bifunctional cross-linking agents include divinylbenzene, divinylnaphthalene, di(meth)acrylate compounds (such as diethylene glycol di(meth)acrylate, methylenebis(meth)acrylamide, decanediol diacrylate, and glycidyl (meth)acrylate), polyester-type di(meth)acrylate, and 2-([1'-methylpropylideneamino]carboxyamino)ethyl methacrylate.

Examples of the polyfunctional cross-linking agent include tri(meth)acrylate compounds (such as pentaerythritol tri(meth)acrylate, trimethylolethane tri(meth)acrylate, and trimethylolpropane tri(meth)acrylate), tetra(meth)acrylate compounds (such as pentaerythritol tetra(meth)acrylate and oligoester (meth)acrylate), 2,2-bis(4-methacryloxy, polyethoxyphenyl)propane, diallyl phthalate, triallyl cyanurate, triallyl isocyanurate, triallyl trimellitate, and diallyl chlorendate.

From the viewpoint of preventing the occurrence of a reduction in image density, preventing the occurrence of image density unevenness, and fixability, the cross-linkable monomer is preferably a bifunctional or higher functional (meth)acrylate compound, more preferably a bifunctional (meth)acrylate compound, still more preferably a bifunctional (meth)acrylate compound having an alkylene group having 6 to 20 carbon atoms, and particularly preferably a bifunctional (meth)acrylate compound having a linear alkylene group having 6 to 20 carbon atoms.

No particular limitation is imposed on the copolymerization ratio of the mass of the cross-linkable monomer to the total mass of the monomers (mass ratio: cross-linkable monomer/all the monomers), but the copolymerization ratio may be 2/1,000 to 20/1,000.

No particular limitation is imposed on the method for producing the styrene-acrylic resin, and any of various polymerization methods (such as solution polymerization, precipitation polymerization, suspension polymerization, bulk polymerization, and emulsion polymerization) may be used. A well-known procedure (such as a batch procedure, a semi-continuous procedure, or a continuous procedure) may be used for the polymerization reaction.

The properties of the amorphous resin will be described.

The glass transition temperature (Tg) of the amorphous resin is preferably from 50° C. to 80° C. inclusive and more preferably from 50° C. to 65° C. inclusive.

The glass transition temperature is determined using a DSC curve obtained by differential scanning calorimetry (DSC). More specifically, the glass transition temperature is determined from "extrapolated glass transition onset temperature" described in glass transition temperature determination methods in "Testing methods for transition temperatures of plastics" in JIS K7121-1987.

The weight average molecular weight (Mw) of the amorphous resin is preferably from 5000 to 1000000 inclusive and more preferably from 7000 to 500000 inclusive.

The number average molecular weight (Mn) of the amorphous resin is preferable from 2000 to 100000 inclusive.

The molecular weight distribution Mw/Mn of the amorphous resin is preferably from 1.5 to 100 inclusive and more preferably from 2 to 60 inclusive.

The weight average molecular weight and the number average molecular weight are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The crystalline resin will be described.

Examples of the crystalline resin include well-known crystalline resins such as crystalline polyester resins and crystalline vinyl resins (such as polyalkylene resins and long chain alkyl (meth)acrylate resins). Of these, crystalline polyester resins are preferred from the viewpoint of mechanical strength of the toner and its low-temperature fixability.

The crystalline polyester resin is, for example, a polycondensation product of a polycarboxylic acid and a polyhydric alcohol. The crystalline polyester resin used may be a commercial product or a synthesized product.

To facilitate the formation of the crystalline structure in the crystalline polyester resin, a polycondensation product obtained using a polymerizable monomer having a linear aliphatic group is preferable to that obtained using a polymerizable monomer having an aromatic group.

Examples of the polycarboxylic acid include aliphatic dicarboxylic acids (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (for example, dibasic acids such as phthalic acid, isophthalic acid, terephthalic acid, and naphthalene-2,6-dicarboxylic acid), anhydrides thereof, and lower alkyl (having, for example, 1 to 5 carbon atoms) esters thereof.

The polycarboxylic acid used may be a combination of a dicarboxylic acid and a tricarboxylic or higher polycarboxylic acid having a crosslinked or branched structure. Examples of the tricarboxylic acid include aromatic carboxylic acids (such as 1,2,3-benzenetricarboxylic acid, 1,2,4-benzenetricarboxylic acid, and 1,2,4-naphthalene tricarboxylic acid), anhydrides thereof, and lower alkyl (having, for example, 1 to 5 carbon atoms) esters thereof.

The polycarboxylic acid used may be a combination of a dicarboxylic acid, a dicarboxylic acid having a sulfonic acid group, and a dicarboxylic acid having an ethylenic double bond.

Any of these polycarboxylic acids may be used alone or in combination of two or more.

The polyhydric alcohol is, for example, an aliphatic diol (e.g., a linear aliphatic diol with a main chain having 7 to 20 carbon atoms). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. In particular, the aliphatic diol is preferably 1,8-octanediol, 1,9-nonanediol, or 1,10-decanediol.

The polyhydric alcohol used may be a combination of a diol and a trihydric or higher polyhydric alcohol having a crosslinked or branched structure. Examples of the trihydric or higher polyhydric alcohol include glycerin, trimethylolethane, trimethylolpropane, and pentaerythritol.

Any of these polyhydric alcohols may be used alone or in combination of two or more.

In the polyhydric alcohol, the content of the aliphatic diol may be 80% by mole or more and preferably 90% by mole or more.

Like the amorphous polyester, the crystalline polyester resin is obtained, for example, by a well-known production method.

The properties of the crystalline resin will be described.

The melting temperature of the crystalline resin is preferably from 50° C. to 100° C. inclusive, more preferably from 55° C. to 90° C. inclusive, and still more preferably from 60° C. to 85° C. inclusive.

The melting temperature is determined using a DSC curve obtained by differential scanning calorimetry (DSC) from "peak melting temperature" described in melting temperature determination methods in "Testing methods for transition temperatures of plastics" in JIS K7121-1987.

The weight average molecular weight (Mw) of the crystalline resin may be from 6000 to 35000 inclusive.

The content of the binder resin is, for example, preferably from 40% by mass to 95% by mass inclusive, more preferably from 50% by mass to 90% by mass inclusive, and still more preferably from 60% by mass to 85% by mass inclusive based on the total mass of the toner particles.

—Coloring Agent—

Examples of the coloring agent include: various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

Any of these coloring agents may be used alone or in combination of two or more.

The coloring agent used may be optionally subjected to surface treatment and may be used in combination with a dispersant. A plurality of coloring agents may be used in combination.

The content of the coloring agent is, for example, preferably from 1% by mass to 30% by mass inclusive and more preferably from 3% by mass to 15% by mass inclusive based on the total mass of the toner particles.

—Release Agent—

Examples of the release agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters.

The melting temperature of the release agent is preferably from 50° C. to 110° C. inclusive and more preferably from 60° C. to 100° C. inclusive.

The melting temperature is determined using a DSC curve obtained by differential scanning calorimetry (DSC) from "peak melting temperature" described in melting temperature determination methods in "Testing methods for transition temperatures of plastics" in JIS K7121-1987.

In particular, an ester-based wax may be used as the release agent from the viewpoint of reducing unevenness in gloss of an image.

The ester-based wax is a wax having an ester bond. The ester-based wax may be a monoester, a diester, a triester, or a tetraester, and any well-known natural or synthetic ester wax can be used.

The ester-based wax may be an ester compound obtained from a higher fatty acid (such as a fatty acid having 10 or more carbon atoms) and a monohydric or polyhydric aliphatic alcohol (such as an aliphatic alcohol having 8 or more carbon atoms) and having a melting temperature of from 60° C. to 110° C. inclusive (preferably from 65° C. to 100° C. include and more preferably from 70° C. to 95° C. inclusive).

Examples of the ester wax include ester compounds obtained from higher fatty acids (caprylic acid, capric acid, lauric acid, myristic acid, palmitic acid, stearic acid, arachidic acid, behenic acid, oleic acid, etc.) and alcohols (monohydric alcohols such as methanol, ethanol, propanol, isopropanol, butanol, capryl alcohol, lauryl alcohol, myristyl alcohol, cetyl alcohol, stearyl alcohol, and oleyl alcohol and polyhydric alcohols such as glycerin, ethylene glycol, propylene glycol, sorbitol, and pentaerythritol). Specific examples of the ester wax include carnauba wax, rice wax, candelilla wax, jojoba oil, Japan tallow, beeswax, Chinese wax, lanolin, and montanic acid ester wax.

When a cross section of a toner particle in which at least two crystalline resin domains satisfy condition (A), condition (B1), condition (B2), condition (C), and condition (D) is observed, it is preferable that domains of the release agent are present at a depth of 50 nm or more from the surface of the toner particle. Specifically, when the cross section of the toner particle is observed, the minimum value of the distances between the surface of the toner particle (i.e., its outer edge) and the release agent domains present in the toner particle is 50 nm or more.

The phrase "the release agent domains are present at a depth of 50 nm or more from the surface of the toner particle" means that no release agent domains are exposed at the surface of the toner particle. If release agent domains are exposed at the surface of toner particles, an external additive adheres to the exposed positions of the release agent in a localized manner. Therefore, when the release agent domains are present at a depth of 50 nm or more from the surface of the toner particles, the external additive is likely to adhere substantially uniformly, so that uneven melting of the toner particles during fixation is likely to be prevented. In this case, unevenness in gloss of an image is likely to be reduced.

Whether the release agent domains are present at a depth of 50 nm or more from the surface of toner particles is checked by the above-described method for observing cross sections of the toner particles.

The ratio of the number of toner particles each including at least two crystalline resin domains satisfying the above conditions and release agent domains present at a depth of 50 nm or more from the surface of the toner particles to the total number of toner particles is preferably 40% by number or more, more preferably 70% by number or more, still more preferably 80% by number or more, and particularly preferably 90% by number or more, from the viewpoint of reducing unevenness in gloss of an image. Ideally, the ratio of the toner particles satisfying the above conditions is 100% by number.

The content of the release agent is, for example, preferably from 1% by mass to 20% by mass inclusive and more preferably from 5% by mass to 15% by mass inclusive based on the total mass of the toner particles.

—Additional Additives—

Examples of the additional additives include well-known additives such as a magnetic material, a charge control agent, and an inorganic powder. These additives are contained in the toner particles as internal additives.

—Properties Etc. of Toner Particles—

The toner particles may have a single layer structure or may be core-shell toner particles having a so-called core-shell structure including a core (core particle) and a coating layer (shell layer) covering the core.

The toner particles having the core-shell structure may each include, for example: a core containing the binder resin and optional additives such as the coloring agent and the release agent; and a coating layer containing the binder resin.

The volume average particle diameter (D50v) of the toner particles is preferably from 2 μm to 15 μm inclusive and more preferably from 4 μm to 8 μm inclusive.

Various average particle diameters of the toner particles and their various particle size distribution indexes are measured using Coulter Multisizer II (manufactured by Beckman Coulter, Inc.), and ISOTON-II (manufactured by Beckman Coulter, Inc.) is used as an electrolyte.

In the measurement, 0.5 mg or more and 50 mg or less of a measurement sample is added to 2 mL of a 5% aqueous solution of a surfactant (for example, sodium alkylbenzenesulfonate) serving as a dispersant. The mixture is added to 100 mL or more and 150 mL or less of the electrolyte.

The electrolyte with the sample suspended therein is subjected to dispersion treatment for 1 minute using an ultrasonic dispersion apparatus, and then the particle size distribution of particles having diameters within the range of from 2 μm to 60 μm inclusive is measured using the Coulter Multisizer II with an aperture having an aperture diameter of 100 μm. The number of particles sampled is 50000.

The particle size distribution measured and divided into particle size ranges (channels) is used to obtain volume-based and number-based cumulative distributions computed from the small diameter side. In the volume-based cumulative distribution, the particle diameter at a cumulative frequency of 16% is defined as a volume-based particle diameter D16v, and the particle diameter at a cumulative frequency of 50% is defined as a volume average particle diameter D50v. Moreover, the particle diameter at a cumulative frequency of 84% is defined as a volume-based particle diameter D84v. In the number-based cumulative distribution, the particle diameter at a cumulative frequency of 16% is defined as a number-based diameter D16p, and the particle diameter at a cumulative frequency of 50% is defined as a number average cumulative particle diameter D50p. Moreover, the particle diameter at a cumulative frequency of 84% is defined as a number-based diameter D84p.

These are used to compute a volume-based particle size distribution index (GSDv) defined as $(D84v/D16v)^{1/2}$ and a number-based particle size distribution index (GSDp) defined as $(D84p/D16p)^{1/2}$.

The average circularity of the toner particles is preferably from 0.94 to 1.00 inclusive and more preferably from 0.95 to 0.98 inclusive.

The circularity of a toner particle is determined as (the peripheral length of an equivalent circle of the toner particle)/(the peripheral length of the toner particle) [i.e., (the peripheral length of a circle having the same area as a projection image of the particle)/(the peripheral length of the projection image of the particle)]. Specifically, the average circularity is a value measured by the following method.

First, the toner particles used for the measurement are collected by suction, and a flattened flow of the particles is formed. Particle images are captured as still images using flashes of light, and the average circularity is determined by subjecting the particle images to image analysis using a flow-type particle image analyzer (FPIA-3000 manufactured by SYSMEX Corporation). The number of particles sampled for determination of the average circularity is 3500.

When the toner contains the external additive, the toner (developer) for the measurement is dispersed in water containing a surfactant, and the dispersion is subjected to ultrasonic treatment. The toner particles with the external additive removed are thereby obtained.

(External Additive)

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particles used as the external additive may be subjected to hydrophobic treatment. The hydrophobic treatment is performed, for example, by immersing the inorganic particles in a hydrophobic treatment agent. No particular limitation is imposed on the hydrophobic treatment agent, and examples thereof include silane-based coupling agents, silicone oils, titanate-based coupling agents, and aluminum-based coupling agents. Any of these coupling agents may be used alone or in combination of two or more.

The amount of the hydrophobic treatment agent is generally, for example, from 1 part by mass to 10 parts by mass inclusive based on 100 parts by mass of the inorganic particles.

Other examples of the external additive include resin particles (particles of resins such as polystyrene, polymethyl methacrylate (PMMA), and melamine resins) and a cleaning activator (a metal salt of a higher fatty acid typified by zinc stearate or particles of a fluorine-based high-molecular weight material).

The amount of the external additives is, for example, preferably from 0.01% by mass to 5% by mass inclusive and more preferably from 0.01% by mass to 2.0% by mass inclusive based on the mass of the toner particles.

(Properties of Toner)

The maximum endothermic peak temperature of the toner according to the present exemplary embodiment during a first heating scan using a differential scanning calorimeter (DSC) may be from 58° C. to 75° C. inclusive. When the maximum endothermic peak temperature of the toner is from 58° C. to 75° C. inclusive, the toner has good low-temperature fixability.

The maximum endothermic peak temperature of the toner during the first heating scan using the differential scanning calorimeter (DSC) is measured as follows.

A differential scanning calorimeter DSC-7 manufactured by PerkinElmer Co., Ltd. is used. To correct the temperature of a detection unit of the device, the melting points of indium and zinc are used. To correct the amount of heat, the heat of fusion of indium is used. An aluminum-made pan is used for a sample, and an empty pan is used as a control. The sample is heated from room temperature to 150° C. at a heating rate of 10° C./minute. A temperature that gives the maximum endothermic peak in the endothermic curve obtained is determined.

(Method for Producing Toner)

Next, a method for producing the toner according to the present exemplary embodiment will be described.

The toner according to the present exemplary embodiment is obtained by producing toner particles and then externally adding the external additive to the toner particles produced.

The toner particles may be produced by a dry production method (such as a kneading-grinding method) or by a wet production method (such as an aggregation/coalescence method, a suspension polymerization method, or a dissolution/suspension method). No particular limitation is imposed on the toner particle production method, and any known production method may be used.

In particular, the aggregation/coalescence method may be used from the viewpoint of obtaining toner particles in which crystalline resin domains satisfy the above conditions.

Specifically, when the toner particles are produced, for example, by the aggregation/coalescence method, the toner particles are produced through:

the step of preparing an amorphous resin particle dispersion containing amorphous resin particles dispersed therein and a crystalline resin particle dispersion containing crystalline resin particles dispersed therein (a resin particle dispersion preparation step);

the step of forming first aggregated particles by aggregating the amorphous resin particles (and optional agents such as a coloring agent and a release agent) in the amorphous resin particle dispersion (the dispersion may optionally contain a coloring agent dispersion and a release agent dispersion mixed therein) (a first aggregated particle forming step);

the step of forming second aggregated particles by, after an aggregated particle dispersion containing the first aggregated particles dispersed therein has been obtained, repeating at least twice a procedure including mixing the aggregated particle dispersion, the amorphous resin particle dispersion, and the crystalline resin particle dispersion (or mixing the aggregated particle dispersion with a solution mixture of the amorphous resin particle dispersion and the crystalline resin particle dispersion) and aggregating the amorphous resin particles and the crystalline resin particles such that these particles further adhere to the surface of the first aggregated particles (a second aggregated particle forming step);

the step of forming third aggregated particles by, after an aggregated particle dispersion containing the second aggregated particles dispersed therein has been obtained, mixing the aggregated particle dispersion with the amorphous resin particle dispersion and aggregating the amorphous resin particles such that the amorphous resin particles adhere to the surface of the second aggregated particles (a third aggregated particle forming step); and the step of forming toner particles by heating an aggregated particle dispersion containing the third aggregated particles dispersed therein to fuse and coalesce the aggregated particles and then subjecting the resulting aggregated particles to rapid cooling, reheating, and slow cooling sequentially (a fusion/coalescence step).

These steps will next be described in detail.

In the following description, a method for obtaining toner particles containing the coloring agent and the release agent will be described, but the coloring agent and the release agent are used optionally. Of course, additional additives other than the coloring agent and the release agent may be used.

—Resin Particle Dispersion Preparing Step—

The resin particle dispersions (the amorphous resin particle dispersion and the crystalline resin particle dispersion) in which the resin particles used as the binder resin are dispersed are prepared. Moreover, for example, a coloring agent particle dispersion in which coloring agent particles are dispersed and a release agent particle dispersion in which release agent particles are dispersed are prepared.

Each of the resin particle dispersions is prepared, for example, by dispersing the corresponding resin particles in a dispersion medium using a surfactant.

Examples of the dispersion medium used for the resin particle dispersions include aqueous mediums.

Examples of the aqueous medium include: water such as distilled water and ion exchanged water; and alcohols. Any of these may be used alone or in combination of two or more.

Examples of the surfactant include: anionic surfactants such as sulfate-based surfactants, sulfonate-based surfactants, phosphate-based surfactants, and soap-based surfactants; cationic surfactants such as amine salt-based surfactants and quaternary ammonium salt-based surfactants; and nonionic surfactants such as polyethylene glycol-based surfactants, alkylphenol ethylene oxide adduct-based surfactants, and polyhydric alcohol-based surfactants. Of these, an anionic surfactant or a cationic surfactant may be used. A nonionic surfactant may be used in combination with the anionic surfactant or the cationic surfactant.

Any of these surfactants may be used alone or in combination of two or more.

To disperse the resin particles in the dispersion medium to form the resin particle dispersions, a commonly used dispersing method that uses, for example, a rotary shearing-type homogenizer, a ball mill using media, a sand mill, or a dyno-mill may be used. The resin particles may be dispersed in the dispersion medium by, for example, a phase inversion emulsification method, but this depends on the type of resin particles.

In the phase inversion emulsification method, the resin to be dispersed is dissolved in a hydrophobic organic solvent that can dissolve the resin, and a base is added to an organic continuous phase (O phase) to neutralize it. Then the aqueous medium (W phase) is added to change the form of the resin from W/O to O/W (so-called phase inversion) to thereby form a discontinuous phase, and the resin is thereby dispersed as particles in the aqueous medium.

The volume average particle diameter of the resin particles dispersed in each of the resin particle dispersions is, for example, preferably from 0.01 μm to 1 μm inclusive, more preferably from 0.08 μm to 0.8 μm inclusive, and still more preferably from 0.1 μm to 0.6 μm inclusive.

The volume average particle diameter of the resin particles is measured as follows. A particle size distribution measured by a laser diffraction particle size measurement apparatus (e.g., LA-700 manufactured by HORIBA Ltd.) is used and divided into different particle diameter ranges (channels), and a cumulative volume distribution computed from the small particle diameter side is determined. The particle diameter at a cumulative frequency of 50% is measured as the volume average particle diameter D50v. The volume average particle diameters of particles in other dispersions are measured in the same manner.

The content of the resin particles contained in each of the resin particle dispersions is, for example, preferably from 5% by mass to 50% by mass inclusive and more preferably from 10% by mass to 40% by mass inclusive.

For example, the coloring agent particle dispersion and the release agent particle dispersion are prepared in a similar manner to the resin particle dispersions. Specifically, the descriptions of the volume average particle diameter of the particles in each of the resin particle dispersions, the dispersion medium for the resin particle dispersions, the dispersing method, and the content of the resin particles are applicable to the coloring agent particles dispersed in the coloring agent particle dispersion and the release agent particles dispersed in the release agent particle dispersion.

—First Aggregated Particle Forming Step—

Next, the amorphous resin particle dispersion, the coloring agent particle dispersion, and the release agent particle dispersion are mixed.

Then the amorphous resin particles, the coloring agent particles, and the release agent particles are hetero-aggregated in the dispersion mixture to form first aggregated particles containing the amorphous resin particles, the coloring agent particles, and the release agent particles and having diameters close to the diameters of target toner particles.

Specifically, for example, a flocculant is added to the dispersion mixture, and the pH of the dispersion mixture is adjusted to acidic (for example, a pH of from 2 to 5 inclusive). Then a dispersion stabilizer is optionally added, and the resulting mixture is heated to the glass transition temperature of the resin particles (specifically, for example, a temperature from the glass transition temperature of the resin particles −30° C. to the glass transition temperature −10° C. inclusive) to aggregate the particles dispersed in the dispersion mixture to thereby form first aggregated particles.

In the first aggregated particle forming step, the flocculant may be added at room temperature (e.g., 25° C.) while the dispersion mixture is agitated, for example, in a rotary shearing-type homogenizer. Then the pH of the dispersion mixture is adjusted to acidic (e.g., a pH of from 2 to 5 inclusive), and the dispersion stabilizer is optionally added. Then the resulting mixture is heated in the manner described above.

Examples of the flocculant include a surfactant with polarity opposite to the polarity of the surfactant added to the dispersion mixture, inorganic metal salts, and divalent and higher polyvalent metal complexes. In particular, when a metal complex is used as the flocculant, the amount of the surfactant used can be reduced, and charging characteristics are improved.

An additive that forms a complex with a metal ion in the flocculant or a similar bond may be optionally used. The additive used may be a chelating agent.

Examples of the inorganic metal salts include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent used may be a water-soluble chelating agent. Examples of the chelating agent include: oxycarboxylic acids such as tartaric acid, citric acid, and gluconic acid; iminodiacetic acid (IDA); nitrilotriacetic acid (NTA); and ethylenediaminetetraacetic acid (EDTA).

The amount of the chelating agent added is, for example, preferably from 0.01 parts by mass to 5.0 parts by mass inclusive and more preferably 0.1 parts by mass or more and less than 3.0 parts by mass based on 100 parts by mass of the amorphous resin particles.

—Second Aggregated Particle Forming Step—

After the aggregated particle dispersion containing the first aggregated particles dispersed therein has been obtained, the aggregated particle dispersion, the amorphous resin particle dispersion, and the crystalline resin particle dispersion are mixed. The aggregated particle dispersion may be mixed with a solution mixture of the amorphous resin particle dispersion and the crystalline resin particle dispersion.

Then the amorphous resin particles and the crystalline resin particles are aggregated in the dispersion containing the first aggregated particles, the amorphous resin particles, and the crystalline resin particles dispersed therein so as to adhere to the surface of the first aggregated particles.

Specifically, for example, after the diameter of the first aggregated particles has reached the target diameter in the first aggregated particle forming step, the amorphous resin particle dispersion and the crystalline resin particle dispersion are added to the first aggregated particle dispersion, and the resulting dispersion is heated to a temperature equal to or lower than the glass transition temperature of the amorphous resin particles.

The above aggregation procedure is repeated at least twice to thereby form second aggregated particles.

—Third Aggregated Particles Forming Step—

After the aggregated particle dispersion containing the second aggregated particles dispersed therein has been obtained, this aggregated particle dispersion is mixed with the amorphous resin particle dispersion.

Then the amorphous resin particles are aggregated in the dispersion containing the second aggregated particles and the amorphous resin particles dispersed therein so as to adhere to the surface of the second aggregated particles.

Specifically, for example, after the diameter of the second aggregated particles has reached the target diameter in the second aggregated particle forming step, the amorphous resin particle dispersion is added to the second aggregated particle dispersion, and the resulting dispersion is heated to a temperature equal to or lower than the glass transition temperature of the amorphous resin particles.

Then the pH of the dispersion is adjusted to stop the progress of aggregation.

—Fusion/Coalescence Step—

Next, the third aggregated particle dispersion containing the third aggregated particles dispersed therein is heated to, for example, a temperature equal to or higher than the glass transition temperature of the amorphous resin particles (e.g., a temperature higher by 10° C. to 30° C. than the glass transition temperature of the amorphous resin particles) to fuse and coalesce the aggregated particles to thereby form toner particles.

After the fusion/coalescence of the aggregated particles by heating, the resulting aggregated particles may be cooled to, for example, 30° C. at a cooling rate of from 5° C./minute to 40° C./minute inclusive. Since the rapid cooling is performed after the third aggregated particle forming step, the surface of the toner particles can easily contract, so that the toner particles can easily crack. By performing the rapid cooling step under the above conditions, cracks may easily propagate from the inner side of the toner particles toward the surface of the toner.

Then the toner particles are reheated at a heating rate of from 0.1° C./minute to 2° C./minute inclusive and held at a temperature equal to or higher than the melting temperature of the crystalline resin−5° C. for 10 minutes or longer. Then the resulting toner particles are slowly cooled at a cooling rate of from 0.1° C./minute to 1° C./minute inclusive. In this manner, crystalline resin domains grow in the directions of the cracks, i.e., the crystalline resin domains grow from the inner side of the toner particles toward their surface, so that the crystalline resin domains can satisfy the conditions described above.

For example, if the toner particles are heated to a temperature equal to or higher than the melting temperature of the release agent at the time of reheating, the release agent domains are likely to grow and reach the vicinity of the surface of the toner particles. Therefore, the heating temperature of the reheating may be a temperature equal to or higher than the melting temperature of the crystalline resin −5° C. and equal to or lower than the melting temperature of the release agent.

The toner particles are obtained through the above-described steps.

A method other than the toner particle production method using the aggregation/coalescence method may be used. So long as the method used includes, after the production of toner particles, subjecting the toner particles to the rapid cooling, reheating, and slow cooling described above, the crystalline resin domains satisfy the above-described conditions.

After completion of the fusion/coalescence step, the toner particles formed in the solution are subjected to a well-known washing step, a well-known solid-liquid separation step, and a well-known drying step to thereby obtain dried toner particles.

From the viewpoint of chargeability, the toner particles may be subjected to displacement washing with ion exchanged water sufficiently in the washing step. No particular limitation is imposed on the solid-liquid separation step. From the viewpoint of productivity, suction filtration, pressure filtration, etc. may be performed in the solid-liquid separation step. No particular limitation is imposed on the drying step. From the viewpoint of productivity, freeze-drying, flash drying, fluidized drying, vibrating fluidized drying, etc. may be used.

The toner according to the present exemplary embodiment is produced, for example, by adding the external additive to the dried toner particles obtained and mixing them. The mixing may be performed, for example, using a V blender, a Henschel mixer, a Loedige mixer, etc. If necessary, coarse particles in the toner may be removed using a vibrating sieving machine, an air sieving machine, etc.

<Electrostatic Image Developer>

An electrostatic image developer according to an exemplary embodiment contains at least the toner according to the preceding exemplary embodiment.

The electrostatic image developer according to the present exemplary embodiment may be a one-component developer containing only the toner according to the preceding exemplary embodiment or a two-component developer containing the toner and a carrier.

No particular limitation is imposed on the carrier, and a well-known carrier may be used. Examples of the carrier include: a coated carrier prepared by coating the surface of a core material formed of a magnetic powder with a coating resin; a magnetic powder-dispersed carrier prepared by dispersing a magnetic powder in a matrix resin; and a resin-impregnated carrier prepared by impregnating a porous magnetic powder with a resin.

In each of the magnetic powder-dispersed carrier and the resin-impregnated carrier, the particles included in the carrier may be used as cores, and the cores may be coated with a coating resin.

Examples of the magnetic powder include: magnetic metal powders such as iron powder, nickel powder, and cobalt powder; and magnetic oxide powders such as ferrite powder and magnetite powder.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins having organosiloxane bonds and modified products thereof, fluorocarbon resins, polyesters, polycarbonates, phenolic resins, and epoxy resins.

The coating resin and the matrix resin may contain an additional additive such as electrically conductive particles.

Examples of the electrically conductive particles include: particles of metals such as gold, silver, and copper; and particles of carbon black, titanium oxide, zinc oxide, tin oxide, barium sulfate, aluminum borate, and potassium titanate.

One example of the method for coating the surface of the core material with the coating resin is a method in which the surface of the core material is coated with a coating layer-forming solution prepared by dissolving the coating resin and various optional additives in an appropriate solvent. No particular limitation is imposed on the solvent, and the solvent may be selected in consideration of the type of resin used, ease of coating, etc.

Specific examples of the resin coating method include: an immersion method in which the core material is immersed in the coating layer-forming solution; a spray method in which the coating layer-forming solution is sprayed onto the surface of the core material; a fluidized bed method in which the coating layer-forming solution is sprayed onto the core material floated by the flow of air; and a kneader-coater method in which the core material of the carrier and the coating layer-forming solution are mixed in a kneader coater and then the solvent is removed.

The mixing ratio (mass ratio) of the toner and the carrier in the two-component developer is preferably toner:carrier=1:100 to 30:100 and more preferably 3:100 to 20:100.

<Image Forming Apparatus/Image Forming Method>

An image forming apparatus according to an exemplary embodiment/an image forming method according to an exemplary embodiment will be described.

The image forming apparatus according to the present exemplary embodiment includes: an image holding member; charging means for charging the surface of the image holding member; electrostatic image forming means for forming an electrostatic image on the charged surface of the image holding member; developing means that contains an electrostatic image developer and develops the electrostatic image formed on the surface of the image holding member with the electrostatic image developer to thereby form a toner image; transferring means for transferring the toner image formed on the surface of the image holding member onto a recording medium; and fixing means for fixing the toner image transferred onto the recording medium. The electrostatic image developer used is the electrostatic image developer according to the preceding exemplary embodiment.

In the image forming apparatus according to the present exemplary embodiment, an image forming method (an image forming method according to the present exemplary embodiment) is performed. The image forming method includes: charging the surface of the image holding member; forming an electrostatic image on the charged surface of the image holding member; developing the electrostatic image formed on the surface of the image holding member with the electrostatic image developer according to the preceding exemplary embodiment to thereby form a toner image; transferring the toner image formed on the surface of the image holding member onto a recording medium; and fixing the toner image transferred onto the surface of the recording medium.

The image forming apparatus according to the present exemplary embodiment is applied to known image forming apparatuses such as: a direct transfer-type apparatus that transfers a toner image formed on the surface of the image holding member directly onto a recording medium; an intermediate transfer-type apparatus that first-transfers a toner image formed on the surface of the image holding member onto the surface of an intermediate transfer body and second-transfers the toner image transferred onto the surface of the intermediate transfer body onto the surface of a recording medium; an apparatus including cleaning means for cleaning the surface of the image holding member after the transfer of the toner image but before charging; and an apparatus including charge eliminating means for eliminating charges on the surface of the image holding member after transfer of the toner image but before charging by irradiating the surface of the image holding member with charge eliminating light.

In the intermediate transfer-type apparatus, the transferring means includes, for example: an intermediate transfer body having a surface onto which a toner image is to be transferred; first transferring means for first-transferring a toner image formed on the surface of the image holding member onto the surface of the intermediate transfer body; and second transferring means for second-transferring the toner image transferred onto the surface of the intermediate transfer body onto the surface of a recording medium.

In the image forming apparatus according to the present exemplary embodiment, for example, a portion including the developing means may have a cartridge structure (process cartridge) that is detachably attached to the image forming apparatus. The process cartridge used may be, for example, a process cartridge including the developing means containing the electrostatic image developer according to the preceding exemplary embodiment.

An example of the image forming apparatus according to the present exemplary embodiment will be described, but this is not a limitation. Major components shown in FIG. 1 will be described, and description of other components will be omitted.

FIG. 1 a schematic configuration diagram showing the image forming apparatus according to the present exemplary embodiment.

The image forming apparatus shown in FIG. 1 includes first to fourth electrophotographic image forming units 10Y, 10M, 10C, and 10K (image forming means) that output yellow (Y), magenta (M), cyan (C), and black (K) images, respectively, based on color-separated image data. These image forming units (hereinafter may be referred to simply as "units") 10Y, 10M, 10C, and 10K are arranged so as to be spaced apart from each other horizontally by a prescribed distance. These units 10Y, 10M, 10C, and 10K may each be a process cartridge detachably attached to the image forming apparatus.

An intermediate transfer belt 20 serving as the intermediate transfer body is disposed above the units 10Y, 10M, 10C, and 10K in FIG. 1 so as to extend through these units. The intermediate transfer belt 20 is wound around a driving roller 22 and a support roller 24 that are disposed so as to be spaced apart from each other in the left-right direction in FIG. 1 and runs in a direction from the first unit 10Y toward the fourth unit 10K, and the support roller 24 is in contact with the inner surface of the intermediate transfer belt 20. A force is applied to the support roller 24 by, for example, an unillustrated spring in a direction away from the driving roller 22, so that a tension is applied to the intermediate transfer belt 20 wound around the rollers. An intermediate transfer body cleaner 30 is disposed on the image holding member-side surface of the intermediate transfer belt 20 so as to be opposed to the driving roller 22.

Four color toners including yellow, magenta, cyan, and black toners contained in toner cartridges 8Y, 8M, 8C, and 8K, respectively, are supplied to developing devices (examples of the developing means) 4Y, 4M, 4C, and 4K, respectively, of the units 10Y, 10M, 10C, and 10K.

The first to fourth units 10Y, 10M, 10C, and 10K have the same structure. Therefore, the first unit 10Y that is disposed upstream in the running direction of the intermediate transfer belt and forms a yellow image will be described as a representative unit. Description of the second to fourth units 10M, 10C, 10K will be omitted by replacing Y (yellow) in the reference symbol in the first unit 10Y with M (magenta), C (cyan), or K (black).

The first unit 10Y includes a photoconductor 1Y serving as an image holding member. A charging roller (an example of the charging means) 2Y, an exposure unit (an example of the electrostatic image forming means) 3, a developing device (an example of the developing means) 4Y, a first transfer roller 5Y (an example of the first transferring means), and a photoconductor cleaner (an example of the cleaning means) 6Y are disposed around the photoconductor 1Y in this order. The charging roller charges the surface of the photoconductor 1Y to a prescribed potential, and the exposure unit 3 exposes the charged surface to a laser beam 3Y according to a color-separated image signal to thereby form an electrostatic image. The developing device 4Y supplies a charged toner to the electrostatic image to develop the electrostatic image, and the first transfer roller 5Y transfers the developed toner image onto the intermediate transfer belt 20. The photoconductor cleaner 6Y removes the toner remaining on the surface of the photoconductor 1Y after the first transfer.

The first transfer roller 5Y is disposed on the inner side of the intermediate transfer belt 20 and placed at a position opposed to the photoconductor 1Y. Bias power sources (not shown) for applying a first transfer bias are connected to the respective first transfer rollers 5Y, 5M, 5C, and 5K. The bias power sources are controlled by an unillustrated controller to change the transfer biases applied to the respective first transfer rollers.

A yellow image formation operation in the first unit 10Y will be described.

First, before the operation, the surface of the photoconductor 1Y is charged by the charging roller 2Y to a potential of −600 V to −800 V.

The photoconductor 1Y is formed by stacking a photosensitive layer on a conductive substrate (with a volume resistivity of, for example, $1\times10^{-6}$ Ωcm or less at 20° C.). The photosensitive layer generally has a high resistance (the resistance of a general resin) but has the property that, when irradiated with a laser beam 3Y, the specific resistance of a portion irradiated with the laser beam is changed. Therefore, the laser beam 3Y is outputted from the exposure unit 3 toward the charged surface of the photoconductor 1Y according to yellow image data sent from an unillustrated controller. The photosensitive layer of the photoconductor 1Y is irradiated with the laser beam 3Y, and an electrostatic image with a yellow image pattern is thereby formed on the surface of the photoconductor 1Y.

The electrostatic image is an image formed on the surface of the photoconductor 1Y by charging and is a negative latent image formed as follows. The specific resistance of the irradiated portions of the photosensitive layer irradiated with the laser beam 3Y decreases, and this causes charges on the surface of the photoconductor 1Y to flow. However, the charges in portions not irradiated with the laser beam 3Y remain present, and the electrostatic image is thereby formed.

The electrostatic image formed on the photoconductor 1Y rotates to a prescribed developing position as the photoconductor 1Y rotates. Then the electrostatic image on the photoconductor 1Y at the developing position is converted to a visible image (developed image) as a toner image by the developing device 4Y.

An electrostatic image developer containing, for example, at least a yellow toner and a carrier is contained in the developing device 4Y. The yellow toner is agitated in the developing device 4Y and thereby frictionally charged. The charged yellow toner has a charge with the same polarity (negative polarity) as the charge on the photoconductor 1Y and is held on a developer roller (an example of a developer holding member). As the surface of the photoconductor 1Y passes through the developing device 4Y, the yellow toner electrostatically adheres to charge-eliminated latent image portions on the surface of the photoconductor 1Y, and the latent image is thereby developed with the yellow toner. Then the photoconductor 1Y with the yellow toner image formed thereon continues running at a prescribed speed, and the toner image developed on the photoconductor 1Y is transported to a prescribed first transfer position.

When the yellow toner image on the photoconductor 1Y is transported to the first transfer position, a first transfer bias is applied to the first transfer roller 5Y, and an electrostatic force directed from the photoconductor 1Y toward the first transfer roller 5Y acts on the toner image, so that the toner image on the photoconductor 1Y is transferred onto the intermediate transfer belt 20. The transfer bias applied in this case has a (+) polarity opposite to the (−) polarity of the toner and is controlled to +10 μA in, for example, the first unit 10Y by the controller (not shown).

The toner remaining on the photoconductor 1Y is removed and collected by the photoconductor cleaner 6Y.

The first transfer biases applied to the first transfer rollers 5M, 5C, and 5K of the second unit 10M and subsequent units are controlled in the same manner as in the first unit.

The intermediate transfer belt 20 with the yellow toner image transferred thereon in the first unit 10Y is sequentially transported through the second to fourth units 10M, 10C and 10K, and toner images of respective colors are superimposed and multi-transferred.

Then the intermediate transfer belt 20 with the four color toner images multi-transferred thereon in the first to fourth units reaches a secondary transfer unit that is composed of the intermediate transfer belt 20, the support roller 24 in contact with the inner surface of the intermediate transfer belt, and a secondary transfer roller (an example of the second transferring means) 26 disposed on the image holding surface side of the intermediate transfer belt 20. A recording paper sheet (an example of the recording medium) P is supplied to a gap between the secondary transfer roller 26 and the intermediate transfer belt 20 in contact with each other at a prescribed timing through a supply mechanism, and a secondary transfer bias is applied to the support roller 24. The transfer bias applied in this case has the same polarity (−) as the polarity (−) of the toner, and an electrostatic force directed from the intermediate transfer belt 20 toward the recording paper sheet P acts on the toner image, so that the toner image on the intermediate transfer belt 20 is transferred onto the recording paper sheet P. In this case, the secondary transfer bias is determined according to a resistance detected by resistance detection means (not shown) for detecting the resistance of the secondary transfer portion and is voltage-controlled.

Then the recording paper sheet P is transported to a press contact portion (nip portion) of a pair of fixing rollers in a fixing device (an example of the fixing means) 28, and the toner image is fixed onto the recording paper sheet P to thereby form a fixed image.

Examples of the recording paper sheet P onto which a toner image is to be transferred include plain paper sheets used for electrophotographic copying machines, printers, etc. Examples of the recording medium include, in addition to the recording paper sheets P, transparencies.

To further improve the smoothness of the surface of a fixed image, it may be necessary that the surface of the recording paper sheet P be smooth. For example, coated paper prepared by coating the surface of plain paper with, for example, a resin, art paper for printing, etc. are suitably used.

The recording paper sheet P with the color image fixed thereon is transported to an ejection unit, and a series of the color image formation operations is thereby completed.

<Process Cartridge/Toner Cartridge>

A process cartridge according to an exemplary embodiment will be described.

The process cartridge according to the present exemplary embodiment includes developing means that contains the electrostatic image developer according to the preceding exemplary embodiment and develops an electrostatic image formed on the surface of the image holding member with the electrostatic image developer to thereby form a toner image. The process cartridge is detachably attached to the image forming apparatus.

The structure of the process cartridge in the present exemplary embodiment is not limited to the above described structure. The process cartridge may include, in addition to the developing unit, at least one optional unit selected from other means such as an image holding member, charging means, electrostatic image forming means, and transferring means.

An example of the process cartridge according to the present exemplary embodiment will be described, but this is not a limitation. Major components shown in FIG. 2 will be described, and description of other components will be omitted.

Figure 2:
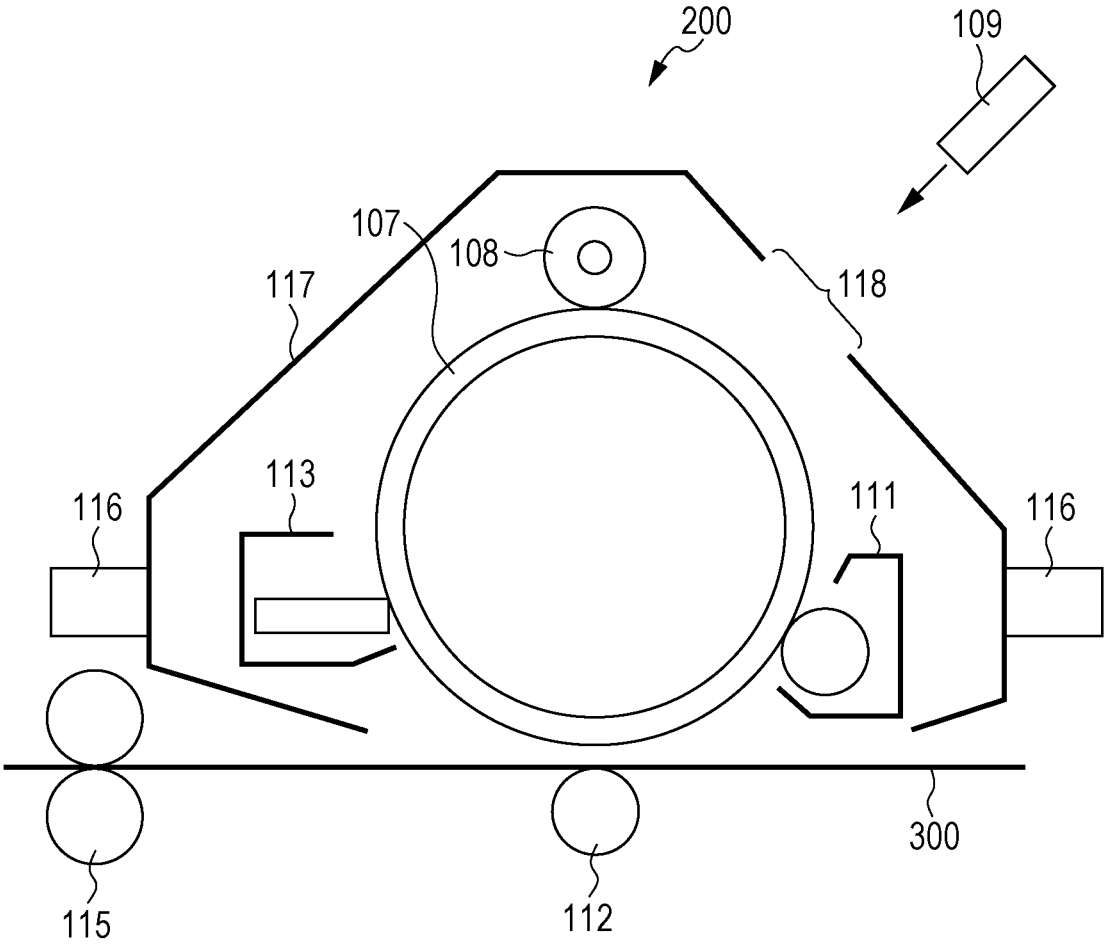
FIG. 2 is a schematic configuration diagram of a process cartridge according to an exemplary embodiment.

FIG. 2 is a schematic configuration diagram showing the process cartridge according to the present exemplary embodiment.

The process cartridge 200 shown in FIG. 2 includes, for example, a housing 117 including mounting rails 116 and an opening 118 for light exposure and further includes a photoconductor 107 (an example of the image holding member), a charging roller 108 (an example of the charging means) disposed on the circumferential surface of the photoconductor 107, a developing device 111 (an example of the developing means), and a photoconductor cleaner 113 (an example of the cleaning means), which are integrally combined to thereby form a cartridge.

In FIG. 2, 109 denotes an exposure unit (an example of the electrostatic image forming means), and 112 denotes a transferring device (an example of the transferring means). 115 denotes a fixing device (an example of the fixing means), and 300 denotes a recording paper sheet (an example of the recording medium).

Next, a toner cartridge according to an exemplary embodiment will be described.

The toner cartridge according to the present exemplary embodiment contains the toner according to the preceding exemplary embodiment and is detachably attached to an image forming apparatus. The toner cartridge contains a replenishment toner to be supplied to the developing means disposed in the image forming apparatus.

The image forming apparatus shown in FIG. 1 has a structure in which the toner cartridges 8Y, 8M, 8C, and 8K are detachably attached, and the developing devices 4Y, 4M, 4C, and 4K are connected to the respective developing devices (corresponding to the respective colors) through unillustrated toner supply tubes. When the amount of the toner contained in a toner cartridge is reduced, this toner cartridge is replaced.

EXAMPLES

The exemplary embodiments will be described in more detail by way of Examples and Comparative Examples. However, the exemplary embodiments are not limited to these Examples. In the following description, "parts" and "%" denoting amounts are based on mass, unless otherwise specified.

<Production of Amorphous Resin>

(Production of Amorphous Polyester Resin (A))

Terephthalic acid: 70 parts
Fumaric acid: 30 parts
Ethylene glycol: 41 parts
1,5-Pentanediol: 48 parts The above components are placed in a 5 L flask equipped with a stirrer, a nitrogen introduction tube, a temperature sensor, and a rectifying column. The temperature of the mixture is increased to 220° C. in a nitrogen gas flow over 1 hour, and 1 part of titanium tetraethoxide is added to 100 parts of the above materials. While water produced is removed by evaporation, the temperature is increased to 240° C. over 0.5 hours. A dehydration condensation reaction is continued at 240° C. for 1 hour, and the reaction product is cooled. Amorphous polyester resin (A) having a weight average molecular weight of 96000 and a glass transition temperature of 61° C. is thereby synthesized.

<Production of Amorphous Resin Particle Dispersion>

(Production of Amorphous Polyester Resin Particle Dispersion (A1))

A container equipped with temperature controlling means and nitrogen purging means is charged with 40 parts of ethyl acetate and 25 parts of 2-butanol to prepare a solvent mixture, and 100 parts of amorphous polyester resin (A) is gradually added to the solvent mixture and dissolved therein. Then a 10% aqueous ammonia solution is added thereto (in a molar amount corresponding to three times the acid value of the resin), and the mixture is stirred for 30 minutes. Next, the container is purged with dry nitrogen, and the temperature is held at 40° C. While the solution mixture is stirred, 400 parts of ion exchanged water is added dropwise at a rate of 2 parts/minute to emulsify the mixture. After completion of the dropwise addition, the temperature of the emulsion is returned to 25° C., and a resin particle dispersion in which resin particles having a volume average particle diameter of 190 nm are dispersed is thereby obtained. Ion exchanged water is added to the resin particle dispersion to adjust the solid content to 20% by mass, and amorphous polyester resin dispersion (A1) is thereby obtained.

<Production of Crystalline Resin>

(Production of Crystalline Polyester Resin (B))

1,10-Decanedicarboxylic acid: 265 parts 1,6-Hexanediol: 168 parts

Dibutyl tin oxide (catalyst): 0.3 parts

The above components are placed in a heat-dried three-neck flask. Air inside the flask is replaced with nitrogen gas by a pressure reducing operation to obtain an inert atmosphere, and the mixture is mechanically stirred at reflux at 180° C. for 5 hours. Next, the temperature is gradually increased to 230° C. under reduced pressure, and the mixture is stirred for 2 hours. When the mixture turns viscous, the resulting mixture is air-cooled to stop the reaction. The weight average molecular weight (Mw) of the obtained "crystalline polyester resin (B)" that is determined by molecular weight (polystyrene-equivalent molecular weight) measurement is 12700, and its melting temperature is 73° C.

<Production of Crystalline Polyester Resin Particle Dispersion>

(Production of Crystalline Polyester Resin Particle Dispersion (B1))

90 Parts of crystalline polyester resin (B), 1.8 parts of an anionic surfactant NEOGEN RK (manufactured by DAI-ICHI KOGYO SEIYAKU Co., Ltd.), and 210 parts of ion exchanged water are mixed, heated to 120° C., dispersed sufficiently using ULTRA-TURRAX T50 manufactured by IKA, and then subjected to dispersion treatment using a pressure ejection-type Gaulin homogenizer for 1 hour, and crystalline polyester resin particle dispersion (B1) containing particles with a volume average particle diameter of 190 nm and having a solid content of 20 parts is thereby obtained.

(Preparation of Coloring Agent Particle Dispersion)

Carbon black (Regal 330 manufactured by Cabot Corporation): 50 parts

Anionic surfactant NEOGEN RK (manufactured by DAI-ICHI KOGYO SEIYAKU Co., Ltd.): 5 parts Ion exchanged water: 193 parts The above components are mixed and treated using Ultimaizer (manufactured by Sugino Machine Limited) at 240 MPa for 10 minutes to thereby prepare a coloring agent particle dispersion (solid content: 20%).

<Preparation of Release Agent Particle Dispersions>

(Preparation of Release Agent Particle Dispersion (W1))

Ester wax (WEP-5 manufactured by NOF CORPORATION, melting temperature: 82° C.): 100 parts Anionic surfactant (NEOGEN RK manufactured by DAI-ICHI KOGYO SEIYAKU Co., Ltd.): 1 part Ion exchanged water: 350 parts The above materials are mixed, heated to 100° C., dispersed using a homogenizer (ULTRA-TURRAX T50 manufactured by IKA), and subjected to dispersion treatment using a Manton-Gaulin high-pressure homogenizer (manufactured by Gaulin Corporation) to thereby obtain a release agent particle dispersion (solid content: 20%) containing dispersed therein release agent particles with a volume average particle diameter of 220 nm.

(Preparation of Release Agent Particle Dispersion (W2))

Paraffin wax (HNP-0190 manufactured by Nippon Seiro Co., Ltd., melting temperature: 89° C.): 100 parts Anionic surfactant (NEOGEN RK manufactured by DAI-ICHI KOGYO SEIYAKU Co., Ltd.): 1 part Ion exchanged water: 350 parts The above materials are mixed, heated to 100° C., dispersed using a homogenizer (ULTRA-TURRAX T50 manufactured by IKA), and subjected to dispersion treatment using a Manton-Gaulin high-pressure homogenizer (manufactured by Gaulin Corporation) to thereby obtain a release agent particle dispersion W2 (solid content: 20%) containing dispersed therein release agent particles with a volume average particle diameter of 220 nm.

(Preparation of Release Agent Particle Dispersion (W3))

Polyethylene wax (PW600 manufactured by TOYO ADL CORPORATION, melting temperature: 91° C.): 100 parts Anionic surfactant (NEOGEN RK manufactured by DAI-ICHI KOGYO SEIYAKU Co., Ltd.): 1 part Ion exchanged water: 350 parts The above materials are mixed, heated to 100° C., dispersed using a homogenizer (ULTRA-TURRAX T50 manufactured by IKA), and subjected to dispersion treatment using a Manton-Gaulin high-pressure homogenizer (manufactured by Gaulin Corporation) to thereby obtain release agent particle dispersion (W3) (solid content: 20%) containing dispersed therein release agent particles with a volume average particle diameter of 220 nm.

Example 1

—Production of Toner Particles—

Ion exchanged water: 215 parts

Amorphous polyester resin particle dispersion (A1): 167 parts

Crystalline polyester resin particle dispersion (B1): 27 parts

Release agent dispersion (W1): 40 parts

Coloring agent dispersion: 20 parts

Anionic surfactant (NEOGEN RK, DAI-ICHI KOGYO SEIYAKU Co., Ltd.: 20%): 2.8 parts The above components are placed in a 3 L reaction vessel equipped with a thermometer, a pH meter, and a stirrer and held at 30° C. and a stirring speed of 150 rpm for 30 minutes while the temperature of the mixture is controlled from the outside using a heating mantle. Then a 0.3 N aqueous nitric acid solution is added to adjust the pH in an aggregation step to 3.0.

While the mixture is dispersed using a homogenizer (ULTRA-TURRAX T50 manufactured by IKA Japan), an aqueous PAC solution prepared by dissolving 0.7 parts of PAC (manufactured by Oji Paper Co., Ltd.: 30% powder) in 7 parts of ion exchanged water is added to the mixture. Then the resulting mixture is heated to 50° C. under stirring to thereby produce aggregated particles serving as core portions (these particles are hereinafter referred to also as "core portion aggregated particles"). The particle diameters of the core portion aggregated particles are measured using Coulter Multisizer II (manufactured by Coulter: aperture diameter: 50 μm) to adjust the volume average particle diameter (D50v) to 4.9 μm. Then a solution mixture of 10 parts of amorphous polyester resin particle dispersion (A1) and 10 parts of crystalline polyester resin particle dispersion (B1) is additionally added. Thirty minutes after the addition, a solution mixture of 10 parts of amorphous polyester resin particle dispersion (A1) and 10 parts of crystalline polyester resin particle dispersion (B1) is additionally added.

This addition procedure is repeated a total of four times. Specifically, the additional addition of the solution mixture of 10 parts of amorphous polyester resin particle dispersion (A1) and 10 parts of crystalline polyester resin particle dispersion (B1) is repeated four times.

Finally, 20 parts of amorphous polyester resin particle dispersion (A1) is additionally added to cause the amorphous polyester resin particles to adhere to the surface of the aggregated particles.

Next, 20 parts of a 10% aqueous NTA (nitrilotriacetic acid) metal salt solution (Chelest 70 manufactured by Chelest) is added, and the pH of the mixture is adjusted to 9.0 using a 1N aqueous sodium hydroxide solution. Then the resulting mixture is heated to 90° C. at a heating rate of 0.05° C./minute, held at 90° C. for 3 hours, and then cooled to 30° C. at a rate of 15° C./minute (first cooling). Then the mixture is heated (reheated) to 80° C., which is a temperature equal to or higher than the melting temperature of the crystalline resin−5° C., at a heating rate of 0.2° C./minute, held at 80° C. for 30 minutes, slowly cooled to 30° C. at 0.5° C./minute (second cooling), and then filtered to thereby obtain crude toner particles. The crude toner particles are redispersed in ion exchanged water and filtered. This procedure is repeated to wash the toner particles until the electric conductivity of the filtrate reaches 20 μS/cm or less. Then the mixture is vacuum-dried in an oven at 40° C. for 5 hours to thereby obtain toner particles with a volume average particle diameter (D50v) of 5.8 μm.

—Production of Toner—

1.5 Parts of hydrophobic silica (RY50 manufactured by Nippon Aerosil Co., Ltd.) is mixed with 100 parts of the obtained toner particles using a sample mill at 10000 rpm for 30 seconds. Then the mixture is sieved using a vibrating sieve with a mesh size of 45 μm to thereby obtain a toner.

Examples 2 to 27

Toner particles are produced in the same manner as in Example 1 except that, when the volume average particle diameter of the core portion aggregated particles reaches a volume average particle diameter shown in Table 1, amorphous polyester resin particle dispersion (A1) and crystalline polyester resin particle dispersion (B1) are additionally added.

However, the cooling rate during the first cooling, and the holding temperature after the reheating, and the cooling rate during the second cooling are set to values shown in Table 1.

In Example 3, toner particles are produced using release agent particle dispersion (W2) instead of release agent particle dispersion (W1) used in Example 1.

In Example 4, toner particles are produced using release agent particle dispersion (W3) instead of release agent particle dispersion (W1) used in Example 101.

Example 28

680 Parts of amorphous polyester resin (A), 200 parts of crystalline polyester resin (B), 40 parts of carbon black (Regal 330), and 80 parts of ester wax (WEP-5) are premixed sufficiently in a Henschel mixer, melt-kneaded using a two-roll mill, cooled, then finely pulverized using a jet mill, and subjected to classification twice using a pneumatic classifier to thereby obtain toner particles.

The toner particles are heated to 70° C., which is a temperature equal to or higher than the melting temperature of the crystalline resin−5° C., and held for 20 minutes. Then the particles are rapidly air-cooled to 30° C. at a cooling rate of 15° C./minute. Then the particles are reheated to 70° C., held for 30 minutes, and slowly air-cooled to 30° C. at a cooling rate of 0.5° C./minute to thereby obtain toner particles.

Example 29

<Production of Polyester Prepolymer>

Ethylene oxide adduct of bisphenol A: 182 parts
Propylene oxide adduct of bisphenol A: 21 parts
Terephthalic acid: 7 parts
Isophthalic acid: 85 parts The above monomers are placed in a well-dried three-neck flask purged with $N_2$. The monomers are heated to 180° C. in a $N_2$ flow to melt them and mixed sufficiently. 0.4 Parts of dibutyltin oxide is added, and then the temperature inside the system is increased to 205° C. While the temperature is maintained at 205° C., the reaction is allowed to proceed. During the reaction, a small amount of sample is repeatedly collected to measure its molecular weight, and the progress of the reaction is controlled by adjusting the temperature or collecting moisture in a reduced pressure atmosphere to thereby obtain a desired condensation product. Next, the temperature is reduced to 175° C., and 8 parts of phthalic anhydride is added. The mixture is stirred for 3 hours in a reduced pressure atmosphere to allow the reaction to proceed.

A well-dried three-neck flask purged with $N_2$ is charged with 200 parts of the above-obtained condensation product, 15 parts of isophorone diisocyanate, and 285 parts of ethyl acetate, and the mixture is heated to 70° C. for 5 hours in a $N_2$ flow to thereby obtain an isocyanate group-containing polyester prepolymer (hereinafter referred to as an "isocyanate-modified polyester prepolymer") (solid concentration: 43%) as the amorphous resin.

(Production of Ketimine Compound)

Methyl ethyl ketone: 20 parts
Isophoronediamine: 15 parts

The above materials are placed in a container, heated to 58° C., and stirred to thereby obtain a ketimine compound.

(Production of Black Pigment Dispersion for Oil Phase Solution)

Carbon black (Regal 330 manufactured by Cabot Corporation): 16 parts
Ethyl acetate: 64 parts
Solsperse 5000 (manufactured by Zeneca Limited): 1.2 parts The above components are mixed and then dissolved/dispersed using a sand mill to thereby obtain a black pigment dispersion for an oil phase solution (solid concentration: 20%).

(Production of Release Agent Dispersion for Oil Phase Solution)

Ester wax (WEP-5 manufactured by NOF CORPORATION, melting temperature 82° C.): 20 parts Ethyl acetate: 180 parts While cooled to 18° C., the above components are wet-pulverized using a microbead disperser (DCP mill) to thereby obtain a release agent dispersion for the oil phase solution (solid concentration: 10%).

(Preparation of Oil Phase Solution)

Black pigment dispersion for oil phase solution: 20 parts

Bentonite (manufactured by Wako Pure Chemical Industries, Ltd.): 5 parts

Ethyl acetate: 35 parts

The above components are placed in a vessel and mixed and stirred sufficiently. The following components are added to the obtained solution mixture.

Amorphous polyester resin A: 40 parts

Crystalline polyester resin B: 20 parts

Release agent dispersion for oil phase solution: 80 parts

Then the mixture is stirred sufficiently to prepare the oil phase solution.

(Production of Styrene-Acrylic Resin Particle Dispersion (1))

Styrene: 75 parts n-Butyl acrylate: 115 parts

Methacrylic acid: 75 parts

Sodium polyoxyalkylene methacrylate sulfate (ELEMINOL RS-30 manufactured by Sanyo Chemical Industries, Ltd.): 8 parts Dodecanethiol: 4 parts The above components are placed in a reaction vessel capable of refluxing and stirred and mixed sufficiently. 800 Parts of ion exchanged water and 1.2 parts of ammonium persulfate are quickly added to the mixture. While the temperature of the mixture is maintained at room temperature or lower, a homogenizer (ULTRA-TURRAX T50 manufactured by IKA) is used to disperse and emulsify the mixture to thereby obtain a white emulsion. The temperature inside the system is increased to 70° C. in a $N_2$ flow under stirring, and the emulsion polymerization is continued in this state for 5 hours. Then 18 part of a 1% aqueous ammonium persulfate solution is gradually added dropwise, and the resulting mixture is held at 70° C. for 2 hours to complete the polymerization.

(Preparation of Water Phase Solution)

Styrene-acrylic resin particle dispersion (1): 50 parts

2% Aqueous solution of CELLOGEN BS-H (CMC, manufactured by DAI-ICHI KOGYO SEIYAKU Co., Ltd.): 170 parts Anionic surfactant (Dowfax 2A1 manufactured by Dow): 3 parts Ion exchanged water: 230 parts The above components are stirred and mixed sufficiently to thereby prepare a water phase solution (solid concentration: 2%).

Oil phase solution: 200 parts

Isocyanate-modified polyester prepolymer: 25 parts

Ketimine compound: 1.5 parts

The above components are placed in a stainless steel-made round bottom flask and stirred using a homogenizer (ULTRA-TURRAX manufactured by IKA) for 2 minutes to prepare an oil phase solution mixture. Then 900 parts of the water phase solution is added to the flask. Right after the addition, the mixture is forcibly emulsified for about 2 minutes using a homogenizer (8500 rpm). Next, the emulsion is stirred at room temperature or lower and normal pressure (1 atm) for about 15 minutes using a paddle stirrer to allow the formation of particles and the urea modification reaction of the polyester resin to proceed. Then, while nitrogen is blown into the suspension at a rate of 2 $m^3$/h and the solvent is removed by evaporation under reduced pressure or removed under normal pressure, the suspension is stirred at 75° C. for 8 hours to complete the urea modification reaction.

The resulting suspension is rapidly cooled to 30° C. at 15° C./minute, reheated to 90° C., and held at 90° C. for 30 minutes. Then the suspension is slowly cooled to 30° C. at 0.5° C./minute.

After the cooling, the suspension of the generated particles is removed from the flask, washed with ion exchanged water sufficiently, and subjected to solid-liquid separation using a Nutsche funnel. Then the solids are redispersed in ion exchanged water at 35° C. and washed for 15 minutes under stirring. The above washing procedure is repeated several times. Then the mixture is subjected to solid-liquid separation using a Nutsche funnel, and the solids are freeze-dried in a vacuum to thereby obtain toner particles.

1.5 Parts of hydrophobic silica (RY50 manufactured by Nippon Aerosil Co., Ltd.) and 1.0 parts of hydrophobic titanium oxide (T805 manufactured by Nippon Aerosil Co., Ltd.) are mixed with 100 parts of the obtained toner particles using a sample mill at 10000 rpm for 30 seconds. Then the mixture is sieved using a vibrating sieve with a mesh size of 45 μm to thereby produce toner particles.

Comparative Example 1: Ordinary Toner

—Production of Toner Particles—

Ion exchanged water: 215 parts

Amorphous polyester resin particle dispersion (A1): 127 parts

Crystalline polyester resin particle dispersion (B1): 67 parts

Release agent dispersion (W1): 40 parts

Coloring agent dispersion: 20 parts

Anionic surfactant (NEOGEN RK manufactured by DAI-ICHI KOGYO SEIYAKU Co., Ltd., 20%): 2.8 parts The above components are placed in a 3 L reaction vessel equipped with a thermometer, a pH meter, and a stirrer and held at 30° C. and a stirring speed of 150 rpm for 30 minutes while the temperature of the mixture is controlled from the outside using a heating mantle. Then a 0.3N aqueous nitric acid solution is added to adjust the pH in an aggregation step to 3.0.

While the mixture is dispersed using a homogenizer (ULTRA-TURRAX T50 manufactured by IKA Japan), an aqueous PAC solution prepared by dissolving 0.7 parts of PAC (manufactured by Oji Paper Co., Ltd.: 30% powder) in 7 parts of ion exchanged water is added to the mixture. Then the resulting mixture is heated to 50° C. under stirring, and particle diameters are measured using Coulter Multisizer II (manufactured by Coulter: aperture diameter: 50 μm) to adjust the volume average particle diameter to 4.9 μm. Then 100 parts of amorphous polyester resin particle dispersion (A1) is additionally added to cause the amorphous polyester resin particles to adhere to the surface of the aggregated particles.

Next, 20 parts of a 10% aqueous NTA (nitrilotriacetic acid) metal salt solution (Chelest 70 manufactured by Chelest) is added, and the pH of the mixture is adjusted to 9.0 using a 1N aqueous sodium hydroxide solution. Then the resulting mixture is heated to 90° C. at a heating rate of 0.05° C./minute, held at 90° C. for 3 hours, and then cooled to 30° C. at a cooling rate of 15° C./minute. Then the mixture is heated to 80° C., which is a temperature equal to or higher than the melting temperature of the crystalline resin −5° C., at a heating rate of 0.2° C./minute, held at 80° C. for 30 minutes, rapidly cooled to 30° C. at 15° C./minute, and filtered to thereby obtain crude toner particles. The crude toner particles are redispersed in ion exchanged water and filtered. This procedure is repeated to wash the toner particles until the electric conductivity of the filtrate reaches 20 μS/cm or less. Then the mixture is vacuum-dried in an oven at 40° C. for 5 hours to thereby obtain toner particles with a volume average particle diameter of 5.8 μm.

—Production of Toner—

1.5 Parts of hydrophobic silica (RY50 manufactured by Nippon Aerosil Co., Ltd.) is mixed with 100 parts of the obtained toner particles using a sample mill at 10000 rpm for 30 seconds. Then the mixture is sieved using a vibrating sieve with a mesh size of 45 μm to thereby obtain a toner.

Comparative Example 2

680 Parts of amorphous polyester resin (A), 200 parts of crystalline polyester resin (B), 40 parts of carbon black (Regal 330), and 80 parts of ester wax (WEP-5) are premixed sufficiently in a Henschel mixer and melt-kneaded using a two-roll mill. The melt-kneaded mixture is extruded from a twin screw extruder, and a sheet-shaped melt-kneaded product is produced using rolling rolls disposed near the twin screw extruder and cooled at 1° C./minute.

The sheet-shaped melt-kneaded product is finely pulverized using a jet mill and subjected to classification twice using a pneumatic classifier to thereby obtain toner particles.

<Properties>

For each of the toners in the Examples and Comparative Examples, the following properties are measured using the method described above.

The aspect ratio of each crystalline resin domain (denoted as "aspect ratio AR" in Table 2)

The length of the major axis of each crystalline resin domain (denoted as "major axis length $L_{Cry}$" in Table 2)

The ratio of the major axis length of each crystalline resin domain to the maximum diameter of the toner particle under observation (denoted as "$L_{Cry}$" in Table 2)

The angle between an extension of the major axis of each crystalline resin domain and the tangent at the point of contact of the extension with the surface of the toner particle under observation (denoted as "angle $\theta_A$ between major axis and tangent" in Table 2)

The crossing angle between extensions of the major axes of two crystalline resin domains (denoted as "crossing angle $\theta_B$ between extensions of major axes" in Table 2)

The minimum value of the distances between the surface (i.e., the outer edge) of the toner particle under observation and release agent domains present in the toner particle (denoted as "minimum distance between domain and surface of toner particle" in Table 2)

The ratio of the number of first toner particles A satisfying conditions below to the total number of toner particles (% by number)

Condition (A): The aspect ratio of each of at least two crystalline resin domains is from 5 to 40 inclusive.

Condition (B1): The length of the major axis of each of the at least two crystalline resin domains is from 0.5 μm to 1.5 μm inclusive.

Condition (C): The angle between an extension of the major axis of each of the at least two crystalline resin domains and a tangent at the point of contact of the extension with the surface of the toner particle under observation is from 60 degrees to 90 degrees inclusive.

Condition (D): The crossing angle between extensions of the major axes of any two of the at least two crystalline resin domains is from 45 degrees to 90 degrees inclusive.

The ratio of the number of first toner particles A further satisfying condition (E) to the total number of toner particles (% by number)

Condition (E): Each release agent domain is present at a depth of 50 nm or more from the surface of the toner particle under observation.

The ratio of the number of first toner particles B satisfying conditions below to the total number of toner particles (% by number)

Condition (A'): The aspect ratio of each of at least two crystalline resin domains is from 10 to 40 inclusive.

Condition (B1'): The length of the major axis of each of the at least two crystalline resin domains is from 0.8 μm to 1.5 μm inclusive.

Condition (C'): The angle between an extension of the major axis of each of the at least two crystalline resin domains and a tangent at the point of contact of the extension with the surface of the toner particle under observation is from 75 degrees to 90 degrees inclusive.

Condition (D'): The crossing angle between extensions of the major axes of any two of the at least two crystalline resin domains is from 60 degrees to 90 degrees inclusive.

The ratio of the number of first toner particles B further satisfying condition (E) below to the total number of toner particles (% by number)

Condition (E): Each release agent domain is present at a depth of 50 nm or more from the surface of the toner particle under observation.

The ratio of the number of second toner particles A satisfying conditions below to the total number of toner particles (% by number)

Condition (A): The aspect ratio of each of at least two crystalline resin domains is from 5 to 40 inclusive.

Condition (B2): In at least one of the at least two crystalline resin domains, the ratio of the length of the major axis to the maximum diameter of the toner particle under observation is from 10% to 30% inclusive.

Condition (C): The angle between an extension of the major axis of each of the at least two crystalline resin domains and a tangent at the point of contact of the extension with the surface of the toner particle under observation is from 60 degrees to 90 degrees inclusive.

Condition (D): The crossing angle between extensions of the major axes of any two of the at least two crystalline resin domains is from 45 degrees to 90 degrees inclusive.

The ratio of the number of second toner particles A further satisfying condition (E) below to the total number of toner particles (% by number)

Condition (E): Each release agent domain is present at a depth of 50 nm or more from the surface of the toner particle under observation.

The ratio of the number of second toner particles B satisfying conditions below to the total number of toner particles (% by number)

Condition (A'): The aspect ratio of each of at least two crystalline resin domains is from 10 to 40 inclusive.

Condition (B2'): In at least one of the at least two crystalline resin domains, the ratio of the length of the major axis to the maximum diameter of the toner particle under observation is from 13% to 30% inclusive.

Condition (C'): The angle between an extension of the major axis of each of the at least two crystalline resin domains and a tangent at the point of contact of the extension with the surface of the toner particle under observation is from 75 degrees to 90 degrees inclusive.

Condition (D'): The crossing angle between extensions of the major axes of any two of the at least two crystalline resin domains is from 60 degrees to 90 degrees inclusive.

The ratio of the number of second toner particles B further satisfying condition (E) below to the total number of toner particles (% by number)

Condition (E): Each release agent domain is present at a depth of 50 nm or more from the surface of the toner particle under observation.

The forms of crystalline resin domains A and B and the form of release agent domains in a representative toner particle are shown in Table 2. Specifically, these are as follows.

100 toner particles in each of the Examples and Comparative Examples are observed. Among the 100 observed toner particles, a toner particle including a crystalline resin domain in which "the angle between an extension of the major axis of the crystalline resin domain and a tangent at the point of contact of the extension with the surface of the toner particle (condition C)" is largest is defined as the representative toner particle.

In the representative toner particle, the crystalline resin domain in which "the angle between the extension of the major axis of the crystalline resin domain and the tangent at the point of contact of the extension with the surface of the toner particle (condition C)" is largest is defined as crystalline resin domain A (see A in FIG. 3). The form of crystalline resin domain A is shown in Table 2.

In the representative toner particle, a crystalline resin domain in which the crossing angle between an extension of its major axis and an extension of the major axis of crystalline resin domain A (condition (D)) is largest is defined as crystalline resin domain B (see B in FIG. 3), and the form of crystalline resin domain B is shown in Table 2.

The crossing angle between the extensions of the major axes of crystalline resin domains A and B in the representative toner particle is shown in Table 2.

The form of each release agent domain in the representative toner particle is shown in Table 2.

<Evaluation>

(Production of Developers)

One of the toners in the Examples and Comparative Examples is used to obtain a developer as follow.

500 Parts of spherical magnetite powder particles (volume average particle diameter: 0.55 μm) are stirred sufficiently using a Henschel mixer, and 5.0 parts of a titanate-based coupling agent is added. The mixture is heated to 100° C. and stirred for 30 minutes to thereby obtain titanate-based coupling agent-coated spherical magnetite particles.

Next, a four-neck flask is charged with 6.25 parts of phenol, 9.25 parts of 35% formalin, 500 parts of the magnetite particles, 6.25 parts of 25% ammonia water, and 425 parts of water, and these components are mixed and stirred. Next, the mixture is allowed to react at 85° C. for 120 minutes under stirring and cooled to 25° C., and 500 parts of water is added. The supernatant is removed, and the precipitate is washed with water. The resulting precipitate is dried at from 150° C. to 180° C. inclusive under reduced pressure to thereby obtain a carrier with an average particle diameter of 35 μm.

The carrier and one of the toners obtained in the Examples and Comparative Examples are placed in a V blender at a ratio of toner:carrier=5:95 (mass ratio) and stirred for 20 minutes to thereby obtain a developer.

(Unevenness in Gloss)

The obtained developers are used to evaluate unevenness in gloss as follows.

One of the developers obtained in the Examples and Comparative Examples is charged into a developing unit of an image forming apparatus "DocuCentre Color 400 manufactured by Fuji Xerox Co., Ltd." This image forming apparatus is used to output Test Chart No. 5-1 available from the Imaging Society of Japan (ISJ) on 1000 sheets of OS coated paper (product name: OS coated paper W manufactured by Fuji Xerox InterField Co., Ltd., 127 g/m$^2$) at a process speed of 228 mm/s in an environment of a temperature of 28° C. and a humidity of 85% RH such that the toner mass per unit area (TMA) in a solid image portion with an area coverage of 100% is 10.0 g/m$^2$. Then the ISJ Test Chart No. 5-1 is printed on 1000 sheets of the OS coated paper using a fixing temperature of 190° C. and a process speed of 90 m/s such that the toner mass per unit area (TMA) in the solid image portion with an area coverage of 100% is 14.4 g/m$^2$.

For each of the ISJ Test Chart No. 5-1 on the 1001st OS coated paper sheet, the ISJ Test Chart No. 5-1 on the 1500th coated paper sheet, and the ISJ Test Chart No. 5-1 on the 2000th coated paper sheet, the gloss of the black solid image portion is measured by the following method.

The gloss is measured using a portable glossmeter (BYK Gardner micro-tri-gloss manufactured by Toyo Seiki Seisaku-sho, Ltd.). Specifically, the gloss at 60 degrees is measured at 5 points.

The measured gloss values are used to determine the difference between the maximum and minimum values, and evaluation is performed according to the following evaluation criteria.

A: The difference between the maximum gloss value and the minimum gloss value in the 1001st, 1500th, and 2000th output images is less than 3°.

B: The difference between the maximum gloss value and the minimum gloss value in the 1001st, 1500th, and 2000th output images is less than 4°.

C: The difference between the maximum gloss value and the minimum gloss value in the 1001st, 1500th, and 2000th output images is less than 6°.

D: The difference between the maximum gloss value and the minimum gloss value in the 1001st, 1500th, and 2000th output images is less than 8°.

E: The difference between the maximum gloss value and the minimum gloss value in the 1001st, 1500th, and 2000th output images is less than 10°.

F: The difference between the maximum gloss value and the minimum gloss value in the 1001st, 1500th, and 2000th output images is 10° or more.

TABLE 1

| | Volume average diameter of core portion aggregated particles D50v (μm) | Cooling rate during first cooling | Holding temperature after reheating | Cooling rate during second cooling | Final volume average toner particle diameter D50v (μm) |
|---|---|---|---|---|---|
| Example 1 | 4.9 | 15° C./min | 80° C. | 0.5° C./min | 5.8 |
| Example 2 | 4.9 | 15° C./min | 92° C. | 0.5° C./min | 5.9 |
| Example 3 | 4.9 | 15° C./min | 80° C. | 0.5° C./min | 5.8 |
| Example 4 | 4.9 | 15° C./min | 80° C. | 0.5° C./min | 5.7 |
| Example 5 | 4.9 | 5° C./min | 92° C. | 1° C./min | 5.8 |
| Example 6 | 4.9 | 15° C./min | 92° C. | 1° C./min | 5.8 |
| Example 7 | 4.9 | 5° C./min | 92° C. | 0.5° C./min | 5.8 |
| Example 8 | 4.9 | 5° C./min | 80° C. | 1° C./min | 5.8 |
| Example 9 | 4.9 | 15° C./min | 80° C. | 1° C./min | 5.8 |
| Example 10 | 4.9 | 5° C./min | 80° C. | 0.5° C./min | 5.8 |
| Example 11 | 3.4 | 5° C./min | 92° C. | 1° C./min | 4.1 |
| Example 12 | 3.4 | 10° C./min | 92° C. | 1° C./min | 4.0 |
| Example 13 | 3.4 | 15° C./min | 92° C. | 1° C./min | 4.1 |
| Example 14 | 3.4 | 10° C./min | 92° C. | 1.5° C./min | 4.1 |
| Example 15 | 3.4 | 15° C./min | 92° C. | 1.5° C./min | 4.2 |
| Example 16 | 3.4 | 5° C./min | 80° C. | 1° C./min | 4.1 |
| Example 17 | 3.4 | 15° C./min | 80° C. | 1° C./min | 4.1 |

TABLE 1-continued

| | Volume average diameter of core portion aggregated particles D50v (μm) | Cooling rate during first cooling | Holding temperature after reheating | Cooling rate during second cooling | Final volume average toner particle diameter D50v (μm) |
|---|---|---|---|---|---|
| Example 18 | 3.4 | 5° C./min | 80° C. | 0.5° C./min | 4.1 |
| Example 19 | 3.4 | 15° C./min | 80° C. | 0.5° C./min | 4.1 |
| Example 20 | 6.9 | 15° C./min | 92° C. | 1° C./min | 8.0 |
| Example 21 | 6.9 | 15° C./min | 92° C. | 0.7° C./min | 8.1 |
| Example 22 | 6.9 | 5° C./min | 92° C. | 0.3° C./min | 8.0 |
| Example 23 | 6.9 | 15° C./min | 92° C. | 0.3° C./min | 8.2 |
| Example 24 | 6.9 | 15° C./min | 80° C. | 1° C./min | 8.0 |
| Example 25 | 6.9 | 15° C./min | 80° C. | 0.7° C./min | 8.0 |
| Example 26 | 6.9 | 5° C./min | 80° C. | 0.3° C./min | 8.1 |
| Example 27 | 6.9 | 15° C./min | 80° C. | 0.3° C./min | 8.0 |
| Example 28 | — | 15° C./min | 70° C. | 0.5° C./min | 6.5 |
| Example 29 | — | 15° C./min | 90° C. | 0.5° C./min | 6.6 |
| Comparative Example 1 | 4.9 | 15° C./min | 80° C. | 15° C./min | 5.8 |
| Comparative Example 2 | — | 1° C./min | — | — | 6.4 |

TABLE 2

| | | Crystalline resin domain A | | | | Crystalline resin domain B | | |
|---|---|---|---|---|---|---|---|---|
| | Volume average toner particle diameter D50v (μm) | Aspect ratio AR | Major axis length $L_{cry}$ μm | Ratio of major axis length to maximum diameter of toner particle % | Angle between major axis and tangent $\theta_A$ Degrees | Aspect ratio AR | Major axis length $L_{cry}$ μm | Ratio of major axis length to maximum diameter of toner particle % |
| Example 1 | 5.8 | 32 | 1.5 | 26 | 89 | 23 | 1.1 | 19 |
| Example 2 | 5.9 | 31 | 1.4 | 24 | 88 | 27 | 1.3 | 22 |
| Example 3 | 5.8 | 22 | 1.1 | 19 | 84 | 25 | 1.2 | 21 |
| Example 4 | 5.7 | 27 | 1.3 | 23 | 86 | 20 | 0.9 | 16 |
| Example 5 | 5.8 | 17 | 0.8 | 14 | 85 | 13 | 0.6 | 10 |
| Example 6 | 5.8 | 19 | 0.9 | 16 | 80 | 15 | 0.7 | 12 |
| Example 7 | 5.8 | 32 | 1.5 | 26 | 88 | 23 | 1.2 | 21 |
| Example 8 | 5.8 | 14 | 0.7 | 12 | 88 | 17 | 0.8 | 14 |
| Example 9 | 5.8 | 13 | 0.6 | 10 | 80 | 19 | 0.9 | 16 |
| Example 10 | 5.8 | 21 | 1.0 | 17 | 86 | 27 | 1.3 | 22 |
| Example 11 | 4.1 | 16 | 0.7 | 17 | 87 | 11 | 0.5 | 12 |
| Example 12 | 4 | 13 | 0.6 | 15 | 82 | 17 | 0.8 | 20 |
| Example 13 | 4.1 | 27 | 1.3 | 32 | 88 | 22 | 1.1 | 27 |
| Example 14 | 4.1 | 10 | 0.4 | 10 | 83 | 11 | 0.5 | 12 |
| Example 15 | 4.2 | 5 | 0.3 | 7 | 86 | 9 | 0.4 | 10 |
| Example 16 | 4.1 | 23 | 0.5 | 12 | 88 | 20 | 0.7 | 17 |
| Example 17 | 4.1 | 20 | 0.8 | 20 | 86 | 30 | 0.5 | 12 |
| Example 18 | 4.1 | 27 | 1.3 | 32 | 82 | 29 | 1.4 | 34 |
| Example 19 | 4.1 | 22 | 1.4 | 34 | 87 | 26 | 1.1 | 27 |
| Example 20 | 8.0 | 10 | 0.5 | 6 | 88 | 15 | 0.6 | 8 |
| Example 21 | 8.1 | 20 | 1.0 | 12 | 86 | 9 | 0.5 | 6 |
| Example 22 | 8.0 | 38 | 1.8 | 23 | 82 | 29 | 1.4 | 18 |
| Example 23 | 8.2 | 31 | 1.5 | 18 | 85 | 36 | 1.7 | 21 |
| Example 24 | 8.0 | 14 | 0.6 | 8 | 83 | 25 | 0.5 | 6 |
| Example 25 | 8.0 | 22 | 1.1 | 14 | 84 | 17 | 0.8 | 10 |
| Example 26 | 8.1 | 38 | 1.8 | 22 | 85 | 35 | 1.7 | 21 |
| Example 27 | 8.0 | 33 | 1.6 | 20 | 86 | 34 | 1.7 | 21 |

TABLE 2-continued

| | | | | | | | | |
|---|---|---|---|---|---|---|---|---|
| Example 28 | 6.5 | 8 | 1.1 | 17 | 74 | 14 | 1.2 | 18 |
| Example 29 | 6.6 | 22 | 1.3 | 20 | 78 | 14 | 0.8 | 12 |
| Comparative Example 1 | 5.8 | 3 | 0.25 | 4 | 52 | 2 | 0.2 | 3 |
| Comparative Example 2 | 5.8 | 16 | 0.8 | 14 | 88 | 14 | 0.7 | 12 |

| | Angle between major axis and tangent $\theta_A$ Degrees | Crossing angle between extensions of major axes of A and B $\theta_B$ Degrees | Release agent domain Type | Release agent domain Minimum distance between domain and surface of toner particle nm |
|---|---|---|---|---|
| Example 1 | 85 | 75 | Ester wax | 60 |
| Example 2 | 72 | 69 | Ester wax | 30 |
| Example 3 | 81 | 76 | Paraffin wax | 60 |
| Example 4 | 80 | 63 | Polyethylene wax | 70 |
| Example 5 | 75 | 77 | Ester wax | 20 |
| Example 6 | 76 | 83 | Ester wax | 30 |
| Example 7 | 82 | 75 | Ester wax | 30 |
| Example 8 | 77 | 53 | Ester wax | 60 |
| Example 9 | 69 | 82 | Ester wax | 70 |
| Example 10 | 80 | 61 | Ester wax | 50 |
| Example 11 | 76 | 48 | Ester wax | 20 |
| Example 12 | 80 | 67 | Ester wax | 20 |
| Example 13 | 73 | 82 | Ester wax | 20 |
| Example 14 | 72 | 52 | Ester wax | 20 |
| Example 15 | 81 | 73 | Ester wax | 20 |
| Example 16 | 75 | 76 | Ester wax | 60 |
| Example 17 | 82 | 81 | Ester wax | 60 |
| Example 18 | 73 | 69 | Ester wax | 60 |
| Example 19 | 80 | 72 | Ester wax | 60 |
| Example 20 | 75 | 73 | Ester wax | 40 |
| Example 21 | 79 | 69 | Ester wax | 40 |
| Example 22 | 76 | 76 | Ester wax | 40 |
| Example 23 | 80 | 53 | Ester wax | 40 |
| Example 24 | 81 | 64 | Ester wax | 60 |
| Example 25 | 76 | 73 | Ester wax | 60 |
| Example 26 | 68 | 68 | Ester wax | 60 |
| Example 27 | 72 | 82 | Ester wax | 60 |
| Example 28 | 65 | 79 | Ester wax | 20 |
| Example 29 | 72 | 73 | Ester wax | 20 |
| Comparative Example 1 | 38 | 52 | Ester wax | 60 |
| Comparative Example 2 | 87 | 2 | Ester wax | 20 |

TABLE 3

| | Ratio of toner particles satisfying specific conditions (% by number) | | | | | | | | |
|---|---|---|---|---|---|---|---|---|---|
| | First toner particles A | First toner particles A satisfying condition E | First toner particles B | First toner particles B satisfying condition E | Second toner particles A | Second toner particles A satisfying condition E | Second toner particles B | Second toner particles B satisfying condition E | Evaluation Unevenness in gloss |
| Example 1 | 94 | 87 | 77 | 73 | 92 | 83 | 76 | 72 | A |
| Example 2 | 81 | 0 | 75 | 0 | 78 | 0 | 70 | 0 | B |
| Example 3 | 82 | 75 | 74 | 70 | 79 | 74 | 73 | 71 | B |
| Example 4 | 86 | 83 | 76 | 73 | 83 | 79 | 74 | 70 | A |
| Example 5 | 37 | 0 | 26 | 0 | 34 | 0 | 24 | 0 | E |
| Example 6 | 47 | 0 | 35 | 0 | 42 | 0 | 32 | 0 | D |
| Example 7 | 77 | 0 | 53 | 0 | 72 | 0 | 47 | 0 | C |
| Example 8 | 27 | 26 | 18 | 18 | 25 | 24 | 16 | 15 | D |
| Example 9 | 51 | 50 | 37 | 35 | 43 | 40 | 29 | 25 | C |
| Example 10 | 72 | 65 | 48 | 44 | 67 | 61 | 45 | 41 | C |
| Example 11 | 28 | 0 | 22 | 0 | 38 | 0 | 31 | 0 | E |
| Example 12 | 51 | 0 | 43 | 0 | 63 | 0 | 52 | 0 | D |
| Example 13 | 72 | 0 | 67 | 0 | 84 | 0 | 73 | 0 | B |
| Example 14 | 0 | 0 | 0 | 0 | 44 | 0 | 31 | 0 | E |
| Example 15 | 7 | 0 | 9 | 0 | 54 | 0 | 42 | 0 | D |
| Example 16 | 37 | 34 | 26 | 24 | 38 | 35 | 27 | 25 | E |
| Example 17 | 48 | 43 | 40 | 34 | 52 | 47 | 35 | 29 | C |
| Example 18 | 75 | 72 | 63 | 59 | 75 | 72 | 63 | 59 | B |
| Example 19 | 83 | 79 | 76 | 71 | 83 | 79 | 76 | 71 | A |
| Example 20 | 49 | 0 | 42 | 0 | 7 | 0 | 3 | 0 | D |
| Example 21 | 48 | 0 | 43 | 0 | 52 | 0 | 48 | 0 | C |

TABLE 3-continued

| | Ratio of toner particles satisfying specific conditions (% by number) | | | | | | | | |
|---|---|---|---|---|---|---|---|---|---|
| | First toner particles A | First toner particles A satisfying condition E | First toner particles B | First toner particles B satisfying condition E | Second toner particles A | Second toner particles A satisfying condition E | Second toner particles B | Second toner particles B satisfying condition E | Evaluation Unevenness in gloss |
| Example 22 | 68 | 0 | 64 | 0 | 74 | 0 | 71 | 0 | B |
| Example 23 | 81 | 0 | 74 | 0 | 85 | 0 | 81 | 0 | B |
| Example 24 | 48 | 41 | 45 | 42 | 6 | 6 | 2 | 2 | D |
| Example 25 | 52 | 44 | 43 | 41 | 51 | 48 | 46 | 43 | C |
| Example 26 | 68 | 64 | 60 | 56 | 76 | 73 | 71 | 66 | B |
| Example 27 | 79 | 77 | 71 | 69 | 86 | 82 | 79 | 75 | A |
| Example 28 | 63 | 0 | 46 | 0 | 57 | 0 | 43 | 0 | C |
| Example 29 | 74 | 0 | 48 | 0 | 66 | 0 | 41 | 0 | C |
| Comparative Example 1 | 0 | 0 | 0 | 0 | 0 | 0 | 0 | 0 | F |
| Comparative Example 2 | 0 | 0 | 0 | 0 | 0 | 0 | 0 | 0 | F |

As can be seen from the above results, in the Examples, the degree of unevenness in gloss that occurs when an image with a large toner mass per unit area is formed is smaller than that in the Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for electrostatic image development comprising toner particles containing an amorphous resin and a crystalline resin, wherein the toner particles include first toner particles, and wherein, when a cross section of each of the first toner particles is observed, at least two domains of the crystalline resin satisfy conditions (A), (B1), (C), and (D) below:

condition (A): an aspect ratio of each of the at least two domains of the crystalline resin is from 5 to 40 inclusive;

condition (B1): a length of a major axis of each of the at least two domains of the crystalline resin is from 0.5 μm to 1.5 μm inclusive;

condition (C): an angle between an extension of the major axis of each of the at least two domains of the crystalline resin and a tangent at a point of contact of the extension with a surface of the each of the first toner particles is from 60 degrees to 90 degrees inclusive; and condition (D): a crossing angle between extensions of major axes of any two of the at least two domains of the crystalline resin is from 45 degrees to 90 degrees inclusive.

2. A toner for electrostatic image development comprising toner particles containing an amorphous resin and a crystalline resin, wherein the toner particles include second toner particles, and wherein, when a cross section of each of the second toner particles is observed, at least two domains of the crystalline resin satisfy conditions (A), (B2), (C), and (D) below:

condition (A): an aspect ratio of each of the at least two domains of the crystalline resin is from 5 to 40 inclusive;

condition (B2): in at least one of the at least two domains of the crystalline resin, a ratio of a length of a major axis to a maximum diameter of the each of the second toner particles is from 10% to 30% inclusive;

condition (C): an angle between an extension of a major axis of each of the at least two domains of the crystalline resin and a tangent at a point of contact of the extension with a surface of the each of the second toner particles is from 60 degrees to 90 degrees inclusive; and condition (D): a crossing angle between extensions of major axes of any two of the at least two domains of the crystalline resin is from 45 degrees to 90 degrees inclusive.

3. The toner for electrostatic image development according to claim 1, wherein the toner particles contain a release agent, and wherein, when a cross section of each of the first toner particles is observed, a domain of the release agent is present at a depth of 50 nm or more from the surface of the each of the first toner particles.

4. The toner for electrostatic image development according to claim 3, wherein the release agent is an ester wax.

5. The toner for electrostatic image development according to claim 1, wherein a ratio of a number of first toner particles to a total number of toner particles is 40% by number or more.

6. The toner for electrostatic image development according to claim 5, wherein the ratio of the number of first toner particles to the total number of toner particles is 70% by number or more.

7. An electrostatic image developer comprising the toner for electrostatic image development according to claim 1.

8. A toner cartridge containing the toner for electrostatic image development according to claim 1, wherein the toner cartridge is detachably attached to an image forming apparatus.

* * * * *